US009268243B2

(12) United States Patent
Aoyama et al.

(10) Patent No.: US 9,268,243 B2
(45) Date of Patent: Feb. 23, 2016

(54) ELECTROPHOTOGRAPHIC MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Takehiko Aoyama, Suntou-gun (JP); Tomohito Taniguchi, Suntou-gun (JP); Kenichi Yamauchi, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 118 days.

(21) Appl. No.: 14/262,442

(22) Filed: Apr. 25, 2014

(65) Prior Publication Data

US 2014/0234764 A1 Aug. 21, 2014

Related U.S. Application Data

(63) Continuation of application No. PCT/JP2013/007131, filed on Dec. 4, 2013.

(30) Foreign Application Priority Data

Dec. 11, 2012 (JP) ..... 2012-270183

(51) Int. Cl.

| | |
|---|---|
| ***G03G 15/00*** | (2006.01) |
| ***G03G 21/18*** | (2006.01) |
| ***G03G 5/04*** | (2006.01) |
| ***G03G 15/02*** | (2006.01) |

(52) U.S. Cl.

CPC ..... *G03G 5/04* (2013.01); *G03G 15/0233* (2013.01); *G03G 21/18* (2013.01)

(58) Field of Classification Search

CPC ..... G03G 5/04; G03G 21/18

See application file for complete search history.

(56) References Cited

U.S. PATENT DOCUMENTS

| | | | |
|---|---|---|---|
| 8,715,830 | B2 | 5/2014 | Yamada et al. |
| 8,725,043 | B2 | 5/2014 | Hoshio |

FOREIGN PATENT DOCUMENTS

| | | | |
|---|---|---|---|
| JP | 2003-316112 | A | 11/2003 |
| JP | 2009-9029 | A | 1/2009 |
| JP | 2009-9056 | A | 1/2009 |
| JP | 2009-9057 | A | 1/2009 |
| JP | 2012-173360 | A | 9/2012 |

OTHER PUBLICATIONS

International Preliminary Report on Patentability, International Application No. PCT/JP2013/007131, Mailing Date Jun. 25, 2015.

Uematsu, et al., U.S. Appl. No. 14/288,810, filed May 28, 2014.

*Primary Examiner* — Stewart Fraser

(74) *Attorney, Agent, or Firm* — Fitzpatrick, Cella, Harper and Scinto

(57) ABSTRACT

Provided is an electrophotographic member for an electrophotographic apparatus, which suppresses the occurrence of a banding image caused by uneven charging. The electrophotographic member includes: an electroconductive substrate; and a surface layer, in which: the surface layer includes a binder resin and an aggregate of at least one crystal particle selected from the group consisting of a flaky crystal particle of magnesium carbonate and a flaky crystal particle of calcium carbonate; an edge face of a card house structure formed of the crystal particle is exposed at a surface of the aggregate; a surface of the surface layer includes a convex portion derived from the aggregate; and a surface of the convex portion has unevenness reflecting a shape of the edge face of the card house structure exposed at the surface of the aggregate.

5 Claims, 5 Drawing Sheets

ELECTROPHOTOGRAPHIC MEMBER, PROCESS CARTRIDGE, AND ELECTROPHOTOGRAPHIC APPARATUS

CROSS-REFERENCE TO RELATED APPLICATIONS

This application is a continuation of International Application No. PCT/JP2013/007131, filed on Dec. 4, 2013, which claims the benefit of Japanese Patent Application No. 2012-270183, filed on Dec. 11, 2012.

BACKGROUND OF THE INVENTION

1. Field of the Invention

The present invention relates to an electrophotographic member, a process cartridge, and an electrophotographic apparatus.

2. Description of the Related Art

An electrophotographic apparatus adopting an electrophotographic system mainly includes an electrophotographic photosensitive member, a charging device, an exposing device, a developing device, a transferring device, and a fixing device. The charging device adopts a system of charging a surface of an electrophotographic photosensitive member by applying a voltage (only a DC voltage or a DC voltage superimposed with an AC voltage) to a charging member disposed so as to be brought into contact or proximity with the surface of the electrophotographic photosensitive member. From the viewpoints of performing charging stably and reducing generation of ozone, a contact charging system of performing charging with a charging member in contact with a surface of an electrophotographic photosensitive member has been preferably used. In the case of the contact charging system, a roller-shaped charging member (hereinafter referred to as "charging roller" has been preferably used.

In the case of using the charging roller in the contact charging system, there is a problem in that a horizontal stripe-like uneven charging image is liable to be formed owing to minute resistance unevenness of the charging member and contamination of a surface of the charging member with toner and an external additive.

In order to solve the above-mentioned problem, various attempts have been made. As one of those attempts, there has been proposed a method involving improving a horizontal stripe-like uneven charging image by incorporating resin particles into a resin layer of a charging roller to form convex portions, thereby uniformizing charging (Japanese Patent Application Laid-Open No. 2003-316112).

Further, as particles for forming the convex portions, composite particles including a spindle-shaped, a cylinder-shaped, or a needle-shaped insulating material as base particles carrying a metal oxide on a surface thereof are used. There has been proposed a method involving improving a defective image caused by contamination and a defective image caused by discharge defects by forming small to large convex shapes using the particles (Japanese Patent Application Laid-Open No. 2009-9029).

SUMMARY OF THE INVENTION

However, in the case of using a charging member in the contact charging system, when convex portions are formed on the surface of the charging member as described above, the contact area between the charging member and an electrophotographic photosensitive member is reduced. Therefore, the driven-rotation performance of the charging member with respect to the electrophotographic photosensitive member is degraded. In association with this, an electrophotographic image having horizontal stripe-like density unevenness (hereinafter sometimes referred to as "banding") is formed in some cases. That is, the follow-up performance of the charging member with respect to the rotation of the electrophotographic photosensitive member by the contact between the electrophotographic photosensitive member and the charging member is degraded, which causes partial unevenness in surface potential of the electrophotographic photosensitive member. The partial unevenness in surface potential is presumed to appear as banding on an electrophotographic image.

In addition, the inventors of the present invention have recognized that, in order to meet a demand for a further increase in process speed of an electrophotographic image forming apparatus in recent years, it is necessary to develop a charging member that has excellent follow-up performance with respect to the rotation of an electrophotographic photosensitive member and is more unlikely to cause the formation of a banding image.

It is an object of the present invention to provide an electrophotographic member that is improved in driven-rotation performance of the electrophotographic member with respect to an electrophotographic photosensitive member to suppress the occurrence of banding and may be suitably used also in an electrophotographic apparatus of high speed, high durability, and high image quality.

It is another object of the present invention to provide a process cartridge and electrophotographic apparatus that contribute to the formation of an electrophotographic image of high quality.

According to one embodiment of the present invention, there is provided an electrophotographic member including: an electroconductive substrate; and a surface layer, in which: the surface layer includes a binder resin and an aggregate of at least one crystal particle selected from the group consisting of a flaky crystal particle of magnesium carbonate and a flaky crystal particle of calcium carbonate; an edge face of a card house structure formed of the crystal particle is exposed on a surface of the aggregate; a surface of the surface layer includes a convex portion derived from the aggregate; and a surface of the convex portion has unevenness reflecting a shape of the edge face of the card house structure exposed at the surface of the aggregate.

Further, according to one embodiment of the present invention, there is provided a process cartridge including the above-mentioned electrophotographic member and an electrophotographic photosensitive member, the process cartridge being removably mounted onto a main body of an electrophotographic apparatus. Further, according to one embodiment of the present invention, there is provided an electrophotographic apparatus including the above-mentioned electrophotographic member and an electrophotographic photosensitive member.

According to one embodiment of the present invention, the driven-rotation performance of an electrophotographic member with respect to an electrophotographic photosensitive member can be further improved. As a result, the occurrence of a banding image caused by uneven charging due to relative speed unevenness between the electrophotographic photosensitive member and the electrophotographic member can be further suppressed.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 1A:
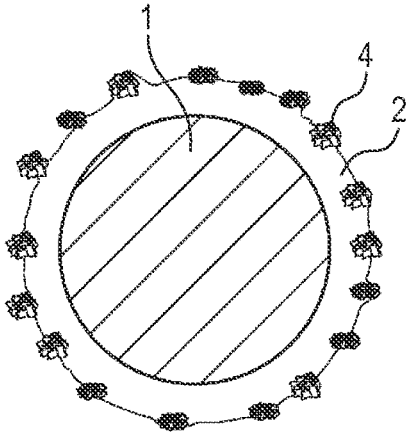
FIG. 1A is a sectional view of an electrophotographic member (roller shape) according to the present invention.
Figure 1B:
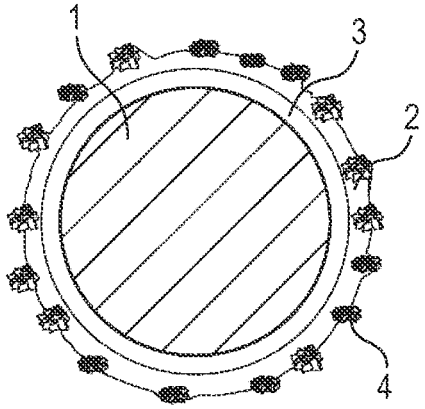
FIG. 1B is a sectional view of the electrophotographic member (roller shape) according to the present invention.

FIG. 1A is a sectional view of an electrophotographic member according to the present invention, and the electrophotographic member includes an electroconductive substrate 1 and a surface layer 2 covering a circumferential surface of the electroconductive substrate 1. In addition, the surface layer 2 contains a binder resin and aggregates 4. As illustrated in FIG. 1B, a conductive elastic layer 3 may be formed between the electroconductive substrate 1 and the surface layer 2.

Figure 2:
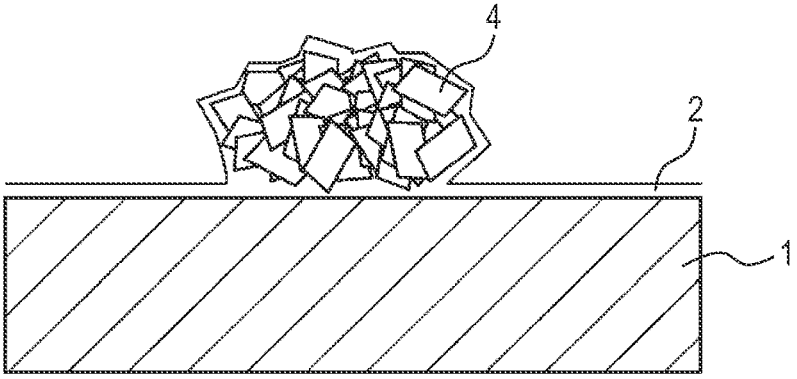
FIG. 2 is a partial sectional view of the electrophotographic member according to the present invention with a surface vicinity thereof being enlarged.

FIG. 2 is a partial sectional view of the surface layer 2 with a surface vicinity thereof being enlarged. Convex portions derived from the aggregates 4 (hereinafter simply referred to as "convex portions") are formed on the surface of the surface layer 2.

Figure 3A:
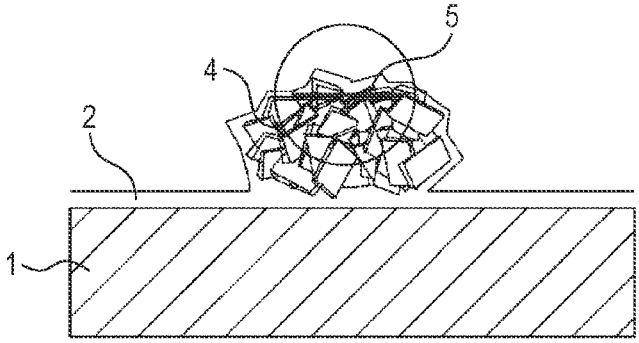
FIG. 3A is a sectional view of the electrophotographic member according to the present invention.
Figure 3B:
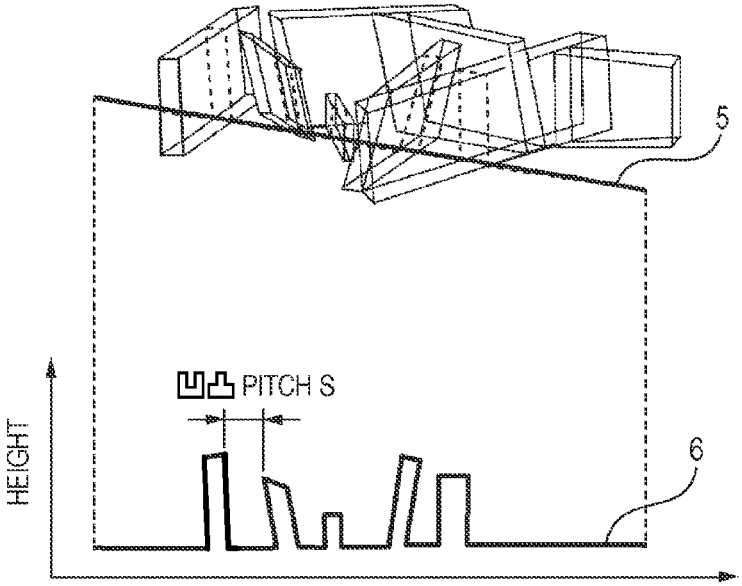
FIG. 3B is a view illustrating an example of a height profile of a convex portion surface of the electrophotographic member according to the present invention.

FIG. 3A is a sectional view of the electrophotographic member according to the present invention. FIG. 3B illustrates a height profile of a convex portion surface in which the circled part of the convex portion surface formed of the aggregate 4 of FIG. 3A is enlarged. Note that the enlarged view of the circled part of the convex portion surface in FIG. 3B is a perspective view. A reference line 5 illustrated in FIG. 3B corresponds to a reference line 5 drawn in parallel to the electroconductive substrate 1 illustrated in FIG. 3A. In FIG. 3B, a broken line passing through the convex portion surface on an outer circumferential side with respect to a horizontal direction of the surface of the electrophotographic member on the reference line 5 is represented as a height profile 6. As represented by the height profile 6 of FIG. 3B, the surface of the convex portion has unevenness reflecting the shape of a card house structure exposed at the surface of the aggregate 4.

Figure 4A:
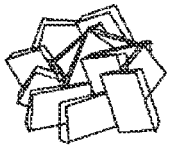
FIG. 4A is a view illustrating an exemplary shape of an aggregate contained in a surface layer of the electrophotographic member according to the present invention.
Figure 4B:
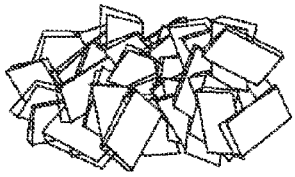
FIG. 4B is a view illustrating another exemplary shape of an aggregate contained in the surface layer of the electrophotographic member according to the present invention.
Figure 4C:
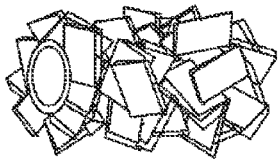
FIG. 4C is a view illustrating still another exemplary shape of an aggregate contained in the surface layer of the electrophotographic member according to the present invention.

Examples of the shape of the aggregate include a spherical shape as illustrated in FIG. 4A, a columnar shape as illustrated in FIG. 4B, and a tubular shape as illustrated in FIG. 4C.

Figure 5A:
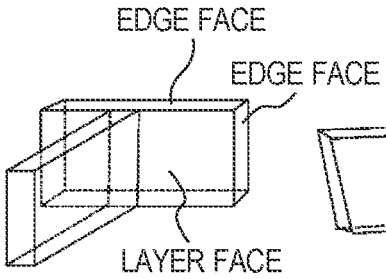
FIG. 5A is a view illustrating an exemplary shape of a card house structure of an aggregate contained in the surface layer of the electrophotographic member according to the present invention.
Figure 5B:
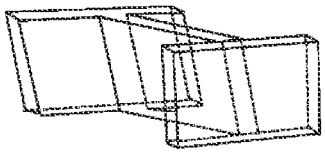
FIG. 5B is a view illustrating an exemplary shape of a card house structure of an aggregate contained in the surface layer of the electrophotographic member according to the present invention.
Figure 5C:
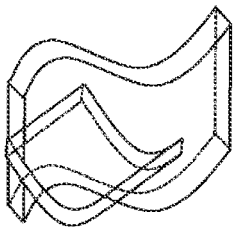
FIG. 5C is a view illustrating an exemplary shape of a card house structure of an aggregate contained in the surface layer of the electrophotographic member according to the present invention.
Figure 5D:
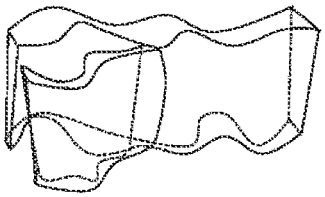
FIG. 5D is a view illustrating an exemplary shape of a card house structure of an aggregate contained in the surface layer of the electrophotographic member according to the present invention.

As illustrated in FIGS. 5A to 5G, the card house structure refers to a structure in which an edge face and a layer face of flaky crystal particles forming the aggregate 4 are in contact with each other selectively. In this case, a crystal particle shape in which edge faces and layer faces of crystal particles are bounded to each other as illustrated in FIG. 5B may be present. Further, a flaky crystal particle may have a wavy shape as illustrated in FIG. 5C, and the thickness of an edge face may not be uniform as illustrated in FIG. 5D.

Figure 5E:
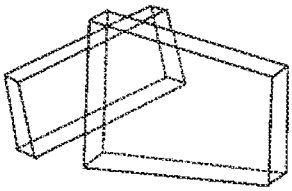
FIG. 5E is a view illustrating an exemplary shape of a card house structure of an aggregate contained in the surface layer of the electrophotographic member according to the present invention.
Figure 5F:
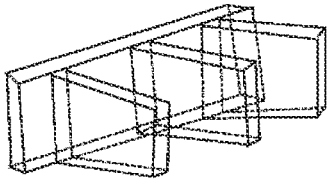
FIG. 5F is a view illustrating an exemplary shape of a card house structure of an aggregate contained in the surface layer of the electrophotographic member according to the present invention.
Figure 5G:
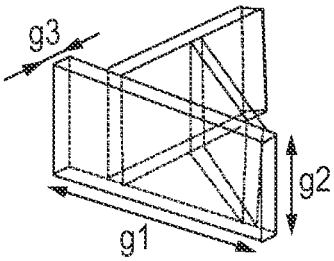
FIG. 5G is a view illustrating an exemplary shape of a card house structure of an aggregate contained in the surface layer of the electrophotographic member according to the present invention.

The magnitude correlation of flaky crystal particles is not particularly limited as illustrated in FIG. 5E, and multiple flaky crystal particles may be in contact with one flaky crystal particle as illustrated in FIG. 5F. Multiple flaky crystal particles come into contact with each other to form a closed structure as illustrated in FIG. 5G. Herein, the layer faces refer to two opposed particle surfaces, each having a particularly large area, of a crystal particle, and the edge faces refer to particle surfaces other than the layer faces.

First, the inventors of the present invention observed the contact and rotation state between the electrophotographic member and an electrophotographic photosensitive member in detail. A convex portion on a surface of the electrophotographic member of the present invention is in contact with a surface of the electrophotographic photosensitive member in a nip with respect to the electrophotographic photosensitive member, and the electrophotographic member has high charging performance. Further, the convex portion derived from the aggregate 4 forms unevenness reflecting the shape of a card house structure exposed at the surface of the aggregate 4.

A surface layer reflecting the shape of an edge face of a card house structure formed of flaky crystal particles mainly comes into contact with the electrophotographic photosensitive member. Herein, the aggregate 4 has a structure in which crystal particles are in contact with each other at edge faces and layer faces without being bounded completely, and hence the edge faces and layer faces of the crystal particles are slightly displaced when the aggregate 4 comes into abutment with the electrophotographic photosensitive member. Therefore, the contact between the aggregate 4 and the electrophotographic photosensitive member at an edge face of a crystal particle forms a line shape reflecting the shape of the edge face instead of a point such as part of the edge face.

Further, the card house structure causes displacement friction in contact portions between the edge faces and layer faces of crystal particles at the time of abutment. Then, when the crystal particles come into strong contact with each other owing to the displacement of the crystal particles, the crystal particles support each other. As a result, the crystal particles can keep in contact with each other in a line shape at the edge faces of the crystal particles without collapsing. The contact state in a line shape at the edge faces of the crystal particles is maintained at the time of abutment, whereby grip property of the electrophotographic member with respect to the electrophotographic photosensitive member for driven rotation is enhanced even at the time of contact on the convex portion. Therefore, the frictionality of the electrophotographic member with respect to the electrophotographic photosensitive member in driven rotation is enhanced.

The inventors of the present invention have considered the following. When the grip property of the electrophotographic member with respect to the electrophotographic photosensitive member is enhanced, the driven-rotation performance of the electrophotographic member with respect to the electrophotographic photosensitive member is enhanced. Thus, the stability of driven rotation of the electrophotographic member with respect to the electrophotographic photosensitive member can be maintained, and banding can be suppressed. Consequently, uneven charging caused by the banding can be suppressed.

In the present invention, the frictionality can be enhanced effectively by controlling the aggregates 4 in the surface layer 2 as described above.

The average particle diameter of the flaky crystal particles of the aggregates 4 in the surface layer 2 is preferably 0.1 μm or more and 10 μm or less, more preferably 0.5 μm or more and 5 μm or less. The average thickness of the flaky crystal particles is preferably 0.005 μm or more and 1 μm or less, more preferably 0.05 μm or more and 0.8 μm or less. The ratio of the average particle diameter with respect to the average thickness of the flaky crystal particles of the aggregates in the surface layer is preferably 1.0 or more and 30 or less, more preferably 2.0 or more and 10 or less.

The displacement of the flaky crystal particles, friction between the edge faces and the layer faces, and support at the time of abutment on the electrophotographic photosensitive member are adjusted by setting each of the "average particle diameter", the "average thickness", and the "ratio of the average particle diameter with respect to the average thickness" in the above-mentioned numerical range. As a result, the above-mentioned characteristics are exhibited more effectively. Herein, the average particle diameter of the flaky crystal particles refers to an average value of a height and a width of the flaky crystal particles in a layer surface.

The average height of the aggregates 4 in the surface layer 2 is preferably 1 μm or more and 30 μm or less, more preferably 5 μm or more and 25 μm or less. The average height of the aggregates 4 refers to an average value of heights of the aggregates 4 in a portion forming the highest convex formed by one aggregate 4 in the surface layer 2.

The aspect ratio, which is a ratio of an average length with respect to the average height of the aggregates 4 in the surface layer 2, is preferably 1 or more and 30 or less, more preferably 1.5 or more and 15 or less.

The average length of the aggregates 4 refers to an average value of lengths of the longest aggregate 4 orthogonal to the average height in one aggregate 4. This is because a convex portion is formed on a surface layer, and in a contact portion between the convex portion and the electrophotographic photosensitive member, the contact by unevenness reflecting a card house structure becomes further continuous. Therefore, the above-mentioned characteristics can be exhibited more effectively.

As an indicator of the driven-rotation performance of the electrophotographic member with respect to the electrophotographic photosensitive member, a dynamic friction coefficient μ of the surface of the electrophotographic member may be used. The dynamic friction coefficient μ preferably falls within a range of 0.15 or more and 0.45 or less. By setting the dynamic friction coefficient μ in this range, the driven rotation of the electrophotographic member with respect to the electrophotographic photosensitive member becomes stable. Therefore, in the case of using the electrophotographic member as a charging member, banding can be suppressed. Note that a measurement method for the dynamic friction coefficient μ of the surface of the electrophotographic member is described later in detail.

<Surface Layer>

Binder Resin

As a binder resin used in the surface layer 2, a known binder resin may be adopted. For example, a resin such as a thermosetting resin or a thermoplastic resin may be used. Examples of the binder resin may include a fluororesin, a polyamide resin, an acrylic resin, a polyurethane resin, an acrylic urethane resin, a silicone resin, and a butyral resin. Those resins may be used alone or in combination of two or more kinds thereof. Further, monomers of those resins may be copolymerized, and the resultant copolymer may be used as the binder resin.

Of those, it is preferred to use at least one resin selected from the group consisting of a urethane resin, an acrylic resin, and a polyamide resin. This is because the adhesiveness and frictionality between the electrophotographic member and the electrophotographic photosensitive member can be controlled more easily.

The surface layer may be formed by adding a cross-linking agent or the like to a raw material for a prepolymerized binder resin, followed by curing or cross-linking.

(Aggregate)

The aggregate 4 to be added to the surface layer 2 of the present invention is formed of an aggregate of at least one crystal particle selected from the group consisting of a flaky crystal particle of magnesium carbonate and a flaky crystal particle of calcium carbonate. Magnesium carbonate and calcium carbonate are materials each having a Mohs' hardness of 3 or more and 4 or less and being capable of forming flaky crystal particles. By setting the crystal particles in the above-mentioned hardness range, the electrophotographic member of the present invention is prevented from damaging the electrophotographic photosensitive member or members that come into contact with the electrophotographic member of the present invention.

Further, even when the contact and release of the electrophotographic member with respect to the members that come into contact with the electrophotographic member are repeated, the members that are in contact with the electrophotographic member are unlikely to be damaged. Further, even when the friction between the electrophotographic member and the members that are in contact with the electrophotographic member is increased, the aggregate itself is not worn down. Therefore, the durability of the electrophotographic member is enhanced. An edge face of a card house structure formed of flaky crystal particles as illustrated in FIGS. 5A to 5G is exposed at the surface of the aggregate 4. The shape of the aggregate is not particularly limited, and examples thereof include a spherical shape as illustrated in FIG. 4A, a columnar shape as illustrated in FIG. 4B, and a tubular shape as illustrated in FIG. 4C. Of those, it is preferred that the aggregate 4 have a columnar shape or a tubular shape.

By forming the aggregate 4 in the above-mentioned shape, an area of the convex portion that comes into contact with the electrophotographic photosensitive member increases, and a continuous card house structure can come into contact with the electrophotographic photosensitive member. Therefore, the effect of the present invention can be expressed effectively.

Further, it is more preferred that the aggregate 4 be formed in a tubular shape. This is because, when the aggregate 4 is formed in a tubular shape, the apparent specific gravity of the aggregate can be decreased. As a result, the aggregate 4 is likely to be present on a surface side of the surface layer 2 in the surface layer 2. Therefore, an uneven shape derived from the card house structure is likely to be formed in the convex portion, and the effect of the present invention can be exhibited sufficiently.

As a specific example of a commercially available aggregate, there is given tubular basic magnesium carbonate ("Mg-Tube" (trade name) manufactured by Nittetsu Mining Co., Ltd.). The aggregate 4 can be produced by the following production method. Examples of the production method include a gas method utilizing a reaction between magnesium hydroxide and carbon dioxide, a soda ash method utilizing a reaction between a soluble magnesium salt such as magnesium chloride and sodium carbonate, and an ammonium carbonate method utilizing a reaction between a soluble magnesium salt and ammonium carbonate.

In those production methods, an aggregate having a shape in which an edge face of a card house structure is exposed at the surface can be produced by adjusting a reaction temperature and a pH as production conditions. Specifically, by controlling the crystal growth speed by the temperature and controlling the charge of edge faces and layer faces of crystal particles by the pH in the process of generation of flaky crystal particles, electrical repulsion occurs between the edge faces or layer faces of the crystal particles, and crystals grow so that the layer faces and the edge faces come into contact with each other.

It is presumed that an aggregate having a shape in which an edge face of a card house structure is exposed at the surface is produced as described above. In any of the above-mentioned production methods, as a generation reaction of a carbonate, there are a method of producing an aggregate through an intermediate product and a method of directly producing an aggregate. Of those, the method of producing an aggregate through an intermediate product is preferred. The reason for this is as follows: according to the method of producing an aggregate through an intermediate product, flaky crystal particles are formed on the surface of an intermediate product; and hence, an edge face of a card house structure formed of the flaky crystal particles is likely to be selectively exposed at the surface of an aggregate to form a shape preferred for exhibiting the above-mentioned characteristics.

In the case where a spherical aggregate is intended to be obtained, it is appropriate to use conditions for generating an aggregate in a high-temperature region. In the case where a columnar aggregate is intended to be obtained, it is appropriate to use conditions for generating an aggregate in a relatively low-temperature region.

In order to obtain the aggregate 4 in a tubular shape, a method including three steps through an intermediate product is preferred. For example, there is given a method including the following three steps: a first step of preparing a hydrogencarbonate solution by introducing a carbon dioxide-containing gas into a hydroxide suspension; a second step of generating an intermediate product by regulating the pH of the hydrogencarbonate solution; and a third step of generating a carbonate by increasing the pH of a suspension of the intermediate product, regulating the temperature thereof, and keeping the temperature.

The liquid temperature in the first step is not particularly limited. However, in the first step, the liquid temperature is held preferably at 10° C. or more and 35° C. or less, more preferably at 10° C. or more and 30° C. or less. By setting the liquid temperature in the above-mentioned temperature range, a stable hydrogencarbonate solution can be prepared.

Further, after the first step, it is preferred to remove insoluble residues such as an unreacted hydroxide and other impurities. Through this operation, a hydrogencarbonate solution containing small amounts of impurities can be prepared, and in the third step, a carbonate having high purity and high uniformity of particles can be obtained.

In the second step, the pH of the hydrogencarbonate solution prepared in the first step is regulated to 7.5 to 11.0 to generate particles of an orthocarbonate. It is preferred that a reaction solution be stirred also in the second step so as to ensure the uniformity of a reaction in the same way as in the first step.

In the second step, it is necessary to increase the pH shifted to a neutral region in the first step to an alkaline region. For this purpose, the pH of the hydrogencarbonate solution prepared in the first step is regulated by adding an appropriate amount of a basic substance to the hydrogencarbonate solution. The basic substance to be used in this case is not particularly limited, and examples thereof may include sodium hydroxide, potassium hydroxide, and ammonia water. By setting the pH in the above-mentioned range, an aggregate of a carbonate is obtained stably in the third step.

The liquid temperature in the second step is set to preferably 20 to 55° C., more preferably 30 to 55° C. By setting the liquid temperature in this range, an intermediate product having a uniform shape can be produced.

In the second step, an intermediate product is generated by regulating the pH and the temperature and allowing the reaction to continue until the generation of the intermediate product is completed. As the shape of the intermediate product, the intermediate product preferably has a minor axis of 0.5 to 10 μm and a major axis of 5 to 500 μm. By setting the minor axis and major axis of the intermediate product in the above-mentioned ranges, an aggregate is obtained stably in the later third step.

It is presumed that the particle shape of an aggregate to be used in the present invention is formed when flaky crystal particles of a carbonate are deposited on the surface of the intermediate product generated in the second step. Further, the shape, in particular, a minor axis and major axis of an aggregate to be produced in the third step are influenced by the minor axis and major axis of the intermediate product to be generated in the second step, and hence it is desired that the minor axis and major axis of the intermediate product to be generated in the second step be regulated in accordance with the shape of an aggregate of interest. In order to regulate the shape of the intermediate product, the pH and the temperature are controlled appropriately in the second step.

For example, an intermediate product having a smaller diameter can be obtained by setting the pH in the second step to a higher pH in the above-mentioned range, and in contrast, an intermediate product having a larger diameter can be obtained by setting the pH to a lower pH in the above-mentioned range. Further, an intermediate product having a smaller diameter can be obtained by setting the temperature in the second step to a higher temperature in the above-mentioned range, and in contrast, an intermediate product having a larger diameter can be obtained by setting the temperature to a lower temperature in the above-mentioned range. Further, it is preferred that the generated intermediate product be once filtered and washed. It is preferred that this operation be performed because the basic substance added in the second step can be removed, and the content of impurities can be reduced.

In the third step as the final step, the pH and temperature of the suspension of the intermediate product obtained in the second step are set to 9.0 to 12.0 and 30 to 75° C., respectively, to generate a carbonate. Further, it is preferred that a reaction solution be stirred also in the third step so as to ensure the uniformity of a reaction in the same way as in the first step and the second step.

The temperature for generating a carbonate in the third step is preferably 30 to 75° C. An aggregate can be produced stably by setting the temperature in this range.

It is preferred that the pH in the third step be adjusted to 9.0 to 12.0. The uniformity of an aggregate can be kept by setting the pH in this range. Further, it is preferred that the pH in the third step be set to be higher than the pH for generating an intermediate product in the second step. By adjusting the pH as described above, an aggregate of a carbonate having high uniformity can be produced more efficiently.

In order to regulate the pH in the above-mentioned range, an acidic substance or a basic substance has only to be added in the third step. Examples of the acidic substance may include hydrochloric acid, sulfuric acid, nitric acid, and acetic acid, and examples of the basic substance may include sodium hydroxide, potassium hydroxide, and ammonia water.

Further, it is preferred that the temperature and pH in the third step be regulated in accordance with the shape, in particular, a minor axis and major axis of the intermediate product generated in the second step. Specifically, in the case where the minor axis of the intermediate product is small, it is preferred that the pH and temperature in the third step be lower, and in contrast, in the case where the minor axis of the intermediate product is large, it is preferred that the pH and temperature in the third step be higher. By adjusting the pH and the temperature as described above, an aggregate of a carbonate having a more uniform shape can be obtained.

The aggregate produced as described above may be formed into dried powder through a dehydration step, a washing step with an organic solvent such as an alcohol, and a drying step.

The obtained aggregate may be used alone or in combination of two or more kinds thereof. Further, the aggregate may be subjected to surface treatment, modification, introduction of a functional group or a molecular chain, coating, and the like. For example, there is given treatment with an organic surface treatment agent such as a surfactant (e.g., a fatty acid salt or a resinate coupling agent) or with inorganic surface treatment agent such as a phosphate or a sulfate.

Further, one kind or two or more kinds of fine particles may be immobilized in the aggregate 4. That is, flaky crystal particles are aggregated so as to cover the periphery of each fine particle. Examples of the fine particles to be immobilized in the aggregate 4 may include oxide particles, hydroxide particles, carbonate particles, halide particles, sulfide particles, multiple oxide particles, metallic particles, mineral particles, and emulsion particles. The shape of the fine particles is not particularly limited, and the fine particles may be in a powdery state or in a suspension state.

The fine particles contained in the aggregate can cover flaky crystal particles while being sufficiently dispersed in the aggregate by subjecting the aggregate to ultrasonic irradiation treatment, physical dispersion treatment using a shearing stress or the like, or dispersion treatment using a dispersant or the like. The fine particles have only to be added before the completion of the generation of a carbonate in the production method for an aggregate. In particular, it is preferred that the fine particles be added after the completion of the deposition of an intermediate product during the production process for an aggregate.

(Conductive Fine Particles)

The surface layer of the present invention may contain known conductive fine particles so as to express conductivity. Examples of the conductive fine particles may include: fine particles or fibers made of metals such as aluminum, palladium, iron, copper, and silver; metal oxides such as titanium oxide, tin oxide, and zinc oxide; composite particles obtained by subjecting the surfaces of the fine particles or fibers made of metals and metal oxides to surface treatment through electrolytic treatment, spray coating, and mixing/shaking; carbon black; and carbon-based fine particles.

Further, the conductive fine particles may be used alone or in combination of two or more kinds thereof. The volume average particle diameter of the conductive fine particles is preferably 0.01 μm or more and 0.9 μm or less, more preferably 0.01 μm or more and 0.5 μm or less. When the volume average particle diameter falls within this range, it becomes easy to control the volume resistivity of the surface layer. Further, the addition amount of a conductive agent to be added to the surface layer is preferably 2 parts by mass or more and 200 parts by mass or less, more preferably 5 parts by mass or more and 100 parts by mass or less with respect to 100 parts by mass of a binder resin.

The surface of the conductive fine particles may be subjected to surface treatment. A surface treatment agent may be exemplified by: organic silicon compounds such as alkoxysilanes, fluoroalkylsilanes, and polysiloxanes; various coupling agents such as silane-based, titanate-based, aluminate-based, and zirconate-based coupling agents; and oligomers and polymeric compounds. One kind of those agents may be used alone or two or more kinds thereof may be used in combination.

<Formation Method for Surface Layer>

As a method of forming a surface layer, there is given a method of forming a coating film by applying a coating material through use of a coating method such as electrostatic spray coating, dip coating, or ring coating. When those coating methods are used, a coating liquid of a conductive resin composition, in which conductive fine particles, an aggregate, and the like are dispersed in a binder resin, is produced and applied. In order to adjust the viscosity of the coating liquid, a solvent may be further used. As the solvent, any solvent may be used as long as it can dissolve the binder resin.

Specific examples thereof may include: alcohols such as methanol, ethanol, and isopropanol; ketones such as acetone, methyl ethyl ketone, and cyclohexanone; amides such as N,N-dimethylformamide, and N,N-dimethylacetamide; sulfoxides such as dimethyl sulfoxide; ethers such as tetrahydrofuran, dioxane, and ethylene glycol monomethyl ether;

esters such as methyl acetate and ethyl acetate; aromatic compounds such as xylene, chlorobenzene, and dichlorobenzene; and petroleum esters such as ligroin.

As a method of dispersing the binder resin, the conductive agent, the aggregate, and the like in the coating liquid, there may be used known solution dispersing means such as a ball mill, a sand mill, a paint shaker, a dyno mill, a pearl mill.

A specific example of the formation method for a surface layer is described below. First, dispersion components other than an aggregate, such as conductive fine particles, are mixed with a binder resin together with glass beads having a diameter of 0.8 mm and dispersed in the binder resin through use of a paint shaker disperser. Then, the glass beads are removed. An aggregate is added to the resultant and dispersed therein in the same way. It is preferred that the dispersion time be 2 minutes or more and 30 minutes or less.

Then, a coating film is formed on an electroconductive substrate or the like by a method such as dip coating. The coating film is dried at a temperature of 20 to 50° C., in particular, 30 to 50° C. After that, the coating film may be subjected to treatment such as curing or cross-linking. Note that as a method of dispersing the binder resin, the conductive fine particles, the aggregate, and the like in the coating liquid, the above-mentioned dispersing means may be used.

The surface layer needs to have a surface forming a convex portion derived from an aggregate. Therefore, it is preferred that the surface layer be thin. Specifically, the thickness of the surface layer in a flat portion not containing an aggregate is preferably 50 μm or less, more preferably 30 μm or less. Thus, it is preferred to form a surface layer by applying a coating material using a solvent by a coating method from the viewpoints of the thickness of the surface layer and the adhesiveness between the binder resin and the aggregate. Note that the thickness of each layer may be measured by cutting a cross-section of a charging member with a sharp blade and observing the cut cross-section with an optical microscope or an electron microscope.

The aggregate 4 may be covered with the surface layer or exposed from the surface layer. Further, the content of the aggregate in the surface layer is preferably 2 parts by mass or more and 200 parts by mass or less, more preferably 15 parts by mass or more and 100 parts by mass or less with respect to 100 parts by mass of the binder resin. When the content of the aggregate 4 is set in the above-mentioned range, a convex portion made of the aggregate can be formed more easily.

It is preferred that the surface state of the surface layer be controlled by the formation of the convex portion as described below. A ten-point average surface roughness Rz is preferably 2 μm or more and 50 μm or less, more preferably 3 μm or more and 40 μm or less. When the ten-point average surface roughness Rz falls within the above-mentioned range, charging performance can be enhanced, and the effect of uniformizing charging can be exhibited sufficiently. Further, an average unevenness interval of unevenness reflecting a card house structure is preferably 0.1 μm or more and 10 μm or less, more preferably 0.15 μm or more and 2 μm or less.

When the average unevenness interval of unevenness is set in the above-mentioned range, the unevenness reflecting a card house structure can come into contact with the electrophotographic photosensitive member with a high density. Therefore, grip property at the time of abutment of the unevenness reflecting a card house structure is further enhanced, and the characteristics of the present invention can be exhibited effectively. Note that the measurement of the ten-point average surface roughness Rz of the surface layer and the average unevenness interval of the unevenness reflecting a card house structure is described later in detail.

The surface layer may be subjected to surface treatment. Examples of the surface treatment may include a surface processing treatment using ultraviolet light (UV) or an electron beam (EB), and surface modifying treatment involving causing a compound to adhere to a surface and/or impregnating a surface with the compound.

(Other Components in Surface Layer)

The surface layer of the present invention may contain an ion conductive agent and insulating particles in addition to the conductive fine particles.

Examples of the ion conductive agent may include: inorganic ionic substances such as lithium perchlorate, sodium perchlorate, and calcium perchlorate; cationic surfactants such as lauryltrimethylammonium chloride, stearyltrimethylammonium chloride, octadecyltrimethylammonium chloride, dodecyltrimethylammonium chloride, hexadecyltrimethylammonium chloride, trioctylpropylammonium bromide, and a modified aliphatic dimethylethylammonium ethosulfate; zwitterionic surfactants such as lauryl betaine, stearyl betaine, and a dimethylalkyllauryl betaine; quaternary ammonium salts such as tetraethylammonium perchlorate, tetrabutylammonium perchlorate, and trimethyloctadecylammonium perchlorate; and organic acid lithium salts such as lithium trifluoromethanesulfonate. One kind of those agents may be used alone or two or more kinds thereof may be used in combination.

Examples of the insulating particles may include particles of zinc oxide, tin oxide, indium oxide, titanium oxide (e.g., titanium dioxide or titanium monoxide), iron oxide, silica, alumina, magnesium oxide, zirconium oxide, strontium titanate, calcium titanate, magnesium titanate, barium titanate, calcium zirconate, barium sulfate, molybdenum disulfide, calcium carbonate, magnesium carbonate, dolomite, talc, kaolin clay, mica, aluminum hydroxide, magnesium hydroxide, zeolite, wollastonite, diatomaceous earth, glass beads, bentonite, montmorillonite, hollow glass spheres, organo metallic compounds, and organo metallic salts; iron oxides such as ferrite, magnetite, and hematite and activated charcoal; and particles formed of polymeric compounds.

Further, the surface layer may further contain a release agent so as to enhance releasability. When the surface layer contains a release agent, dirt is prevented from adhering to the surface of the charging member, and the durability of the charging member can be enhanced. In the case where the release agent is a liquid, the release agent also serves as a leveling agent in the formation of the surface layer.

<Electroconductive Substrate>

The electroconductive substrate has conductivity, and serves to support a surface layer and the like to be formed thereon. Examples of the material for the electroconductive substrate may include metals such as iron, copper, stainless steel, aluminum, and nickel, and alloys thereof. Further, the surfaces of those metals may be subjected to plating for the purpose of imparting scratch resistance as long as the conductivity is not impaired. Further, as the electroconductive substrate, a substrate made of a resin whose surface is covered with a metal so as to have surface conductivity or a substrate formed of a conductive resin composition may be used.

A layer immediately above the electroconductive substrate may be caused to adhere to the electroconductive substrate via an adhesive. In this case, it is preferred that the adhesive be conductive. The adhesive may contain a known conductive agent so as to be conductive.

A thermosetting resin or a thermoplastic resin is given as a binder resin for the adhesive, and there may be used a known urethane-based, acrylic, polyester-based, polyether-based, or epoxy-based resin.

As the conductive agent for imparting conductivity to the adhesive, a conductive agent may be selected appropriately from the above-mentioned conductive fine particles and ion conductive agents and used alone or in combination of two or more kinds thereof.

<Conductive Elastic Layer>

A conductive elastic layer may be formed between the electroconductive substrate and the surface layer. As a binder resin to be used in the conductive elastic layer, a known resin or rubber may be used. Examples of the binder resin may include a resin, natural rubber, vulcanized natural rubber, and synthetic rubber. As the resin, a resin such as a thermosetting resin or a thermoplastic resin may be used.

Examples thereof include a fluororesin, a polyamide resin, an acrylic resin, a polyurethane resin, a silicone resin, and a butyral resin. Examples of the synthetic rubber include ethylene-propylene-diene rubber (EPDM), styrene-butadiene rubber (SBR), silicone rubber, urethane rubber, isoprene rubber (IR), butyl rubber, acrylonitrile-butadiene rubber (NBR), chloroprene rubber (CR), acrylic rubber, and epichlorohydrin rubber. In addition, examples thereof include thermoplastic elastomers such as a styrene-butadiene-styrene block copolymer (SBS) and a styrene-ethylene-butylene-styrene block copolymer (SEBS). One kind of those resins may be used alone or two or more kinds thereof may be used as a mixture.

Of those, it is more preferred to use polar rubber because of ease of resistance adjustment. Examples of the polar rubber may include epichlorohydrin rubber and NBR. Those rubbers are advantageous in that they allow the resistance and hardness of the conductive elastic layer to be controlled easily. It is preferred that the conductive elastic layer have a volume resistivity of $10^2$ Ω·cm or more and $10^{10}$ Ω·cm or less in an environment at a temperature of 23° C. and a relative humidity of 50%.

The volume resistivity of the conductive elastic layer may be adjusted by appropriately adding a conductive agent such as carbon black, a conductive metal oxide, an alkal metal salt, or an ammonium salt to a binder resin. In the case where the binder resin is polar rubber, in particular, an ammonium salt is used preferably. Further, in order to adjust the hardness and the like, the conductive elastic layer may contain additives such as softening oil and a plasticizer, and the above-mentioned insulating particles in addition to the conductive fine particles. The conductive elastic layer may also be formed by being caused to adhere to the electroconductive substrate, the surface layer, or the like via an adhesive. As the adhesive, a conductive adhesive is preferably used.

<Charging Member>

The electrophotographic member according to the present invention has only to have the above-mentioned electroconductive substrate and surface layer, and the shape of the electrophotographic member may be any of a roller shape, a belt shape, and the like. In the following, a charging member such as a charging roller is described in detail as an exemplary electrophotographic member.

EXAMPLES

The present invention is hereinafter described in more detail by way of specific examples. However, the present invention is not limited to the following examples. First, an evaluation method in the present invention is described below.

(1. Measurement of Average Particle Diameter, Average Thickness, and Ratio of Average Particle Diameter with Respect to Average Thickness of Flaky Crystal Particles Forming Aggregate in Surface Layer)

The average particle diameter and average thickness of flaky crystal particles forming an aggregate were calculated from a cross-section photograph of a surface layer. Any convex portion on a surface layer was embedded with a carbon-based resin and cut into portions of 20 nm with a focused ion beam ("FB-2000C" (trade name) manufactured by Hitachi, Ltd.), and each cross-section image was photographed with an electron microscope. Then, images obtained by photographing the same aggregate were combined at an interval of 20 nm and the three-dimensional aggregate shape was calculated.

Regarding any flaky crystal particle in the calculated three-dimensional aggregate shape, an average of the length of a portion in which the distance between opposed edge faces of the crystal particle is longest and the length of a portion in which the distance is shortest was defined as a diameter of the crystal particle, and the width of the edge face was defined as a thickness of the crystal particle. For example, in an example of FIG. 5G, the "length of a portion in which the distance between opposed edge faces of the crystal particle is longest" is represented by g1, and the "length of a portion in which the distance between opposed edge faces of the crystal particle is shortest" is represented by g2. Further, the "average of the length of a portion in which the distance between opposed edge faces of the crystal particle is longest and the length of a portion in which the distance is shortest" is represented by (g1+g2)/2, and the "width of the edge face" is represented by g3.

The operation of defining the "average of the length of a portion in which the distance between opposed edge faces of the crystal particle is longest and the length of a portion in which the distance is shortest as the diameter of the crystal particle" and defining the "width of the edge face as the thickness of the crystal particle" was performed for 10 flaky crystal particles in one aggregate. Further, the operation was performed for any 9 aggregates each forming a convex portion on the surface. An average value of the obtained values of 100 pieces in total ((10 aggregates)×(10 flaky crystal particles)) was calculated for each of the "diameter of the crystal particle" and the "thickness of the crystal particle." The resultant average values were defined as an average particle diameter and average thickness of the flaky crystal particles forming an aggregate in the surface layer. The proportion of the calculated average particle diameter with respect to the calculated average thickness was calculated as a ratio.

(2. Measurement of Shape, Average Length, Average Height, Average Inner Diameter, and Aspect Ratio of Aggregate in Surface Layer)

A three-dimensional aggregate shape was calculated in the same way as in the measurement of an average particle diameter and average thickness of flaky crystal particles forming an aggregate in the surface layer. In the calculated three-dimensional aggregate shape, the height of the aggregate 4 in the highest portion forming a convex and the length of the longest portion of the aggregate 4 that was orthogonal to a line forming the height were determined. In the case of an aggregate having a tubular shape, the diameter of a hollow portion at a height measurement position was defined as an inner diameter.

This operation was performed for any 100 aggregates each forming a convex portion on the surface, and the average values were calculated to be defined as the average height, average length, and average inner diameter of the aggregates.

A proportion of the calculated average length with respect to the calculated average height was defined as an aspect ratio.

(3. Measurement of Average Unevenness Interval of Card House Structure on Surface of Aggregate Forming Convex Portion of Surface Layer)

Any convex portion of a surface layer was embedded with a carbon-based resin and was cut out with a focused ion beam ("FB-2000C" (trade name) manufactured by Hitachi, Ltd.) in a major axis direction of an aggregate. A cross-section image thereof was photographed with an electron microscope. An uneven shape of a convex portion surface was read from the cross-section image. In the read uneven shape, a distance from a convex derived from any card house structure present on the outer periphery to a convex adjacent to the convex derived from any card house structure (unevenness interval S illustrated in FIG. 3B) is determined. Those operations were performed for 10 positions of one convex portion cross-section image. Then, the similar measurement was performed for any 10 aggregates each forming a convex portion on the surface, and an average value of the obtained values of 100 aggregates in total was calculated. This value was defined as an average unevenness interval in a card house structure (hereinafter referred to as "card house structure unevenness interval").

(4. Measurement of Surface Roughness Rz of Electrophotographic Member)

A surface roughness Rz was measured through use of a surface roughness measuring instrument ("SE-3500" (trade name) manufactured by Kosaka Laboratory Ltd.) in accordance with JIS B 0601-1994 surface roughness specifications. The Rz is an average value of values obtained by measuring an electrophotographic member for surface roughness at any 6 positions. Note that a cut-off value was 0.8 mm, and an evaluation length was 8 mm.

(5. Measurement of Dynamic Friction Coefficient μ Of Surface of Electrophotographic Member)

Figure 6:
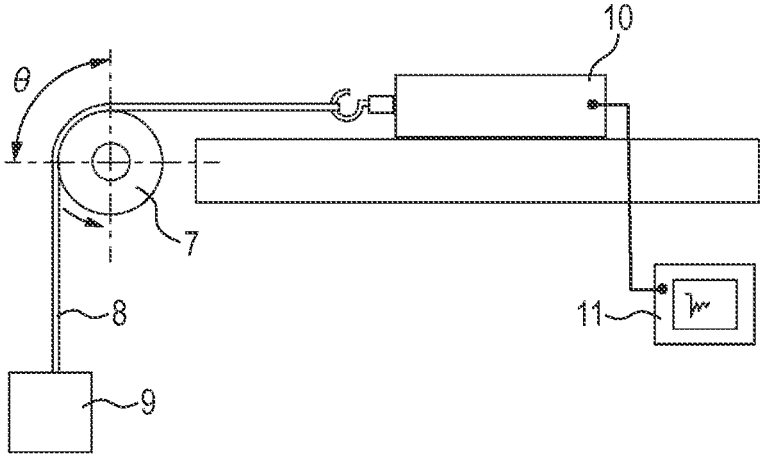
FIG. 6 is a view illustrating a measurement apparatus for measuring a dynamic friction coefficient of a surface of the electrophotographic member according to the present invention.

FIG. 6 illustrates a measurement method for a dynamic friction coefficient μ of a surface of an electrophotographic member. A weight 9 was connected to one end of a belt 8 (made of polyethylene terephthalate, thickness: 100 μm, width: 30 mm, length: 180 mm ("Lumirror S10 #100" (trade name) manufactured by Toray Industries Inc.)). A load meter 10 connected to a recorder 11 was connected to the other end of the belt 8. The belt 8 was brought into contact with the electrophotographic member 7 at a predetermined angle θ. A force measured with the load meter 10 when the electrophotographic member 7 was rotated in a predetermined direction at a predetermined speed in this state was defined as "F", and a total weight of the weight and the belt was defined as "W". A friction coefficient was determined from this result by the following expression.

$$\text{Friction coefficient}=(1/\theta)\ln(F/W)$$

Figure 7:
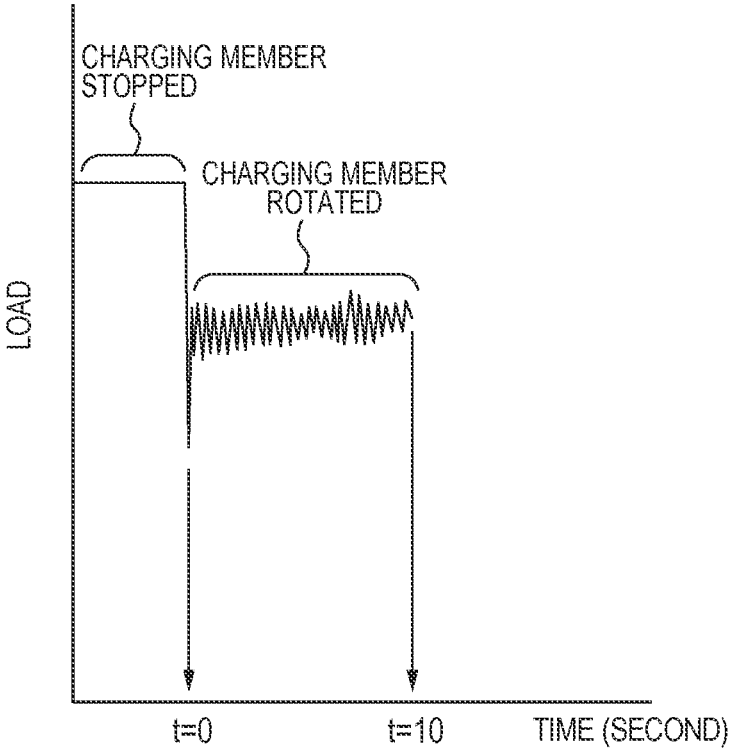
FIG. 7 is an exemplary chart obtained by measuring a dynamic friction coefficient of a surface of the electrophotographic member according to the present invention.

FIG. 7 shows an exemplary chart obtained by the above-mentioned measurement method. A value (value of a vertical axis (load) shown in FIG. 7) immediately before the start of rotation of the electrophotographic member 7 is a force required for starting the rotation, and a subsequent value is a force required for continuing the rotation. A friction coefficient immediately before a rotation start point (t=0) is a static friction coefficient, and a friction coefficient at any time satisfying a relationship of t>0 is a dynamic friction coefficient at any time. A friction coefficient obtained 10 seconds after the start of the rotation was defined as a dynamic friction coefficient μ of the surface of the electrophotographic member. Note that the "W" is set to 100 gf, a rotation speed of the electrophotographic member was set to 115 rpm, and a measurement environment was set to a temperature of 23° C. and a humidity of 53% RH.

PRODUCTION EXAMPLES

Production Examples 1 to 94 are described below, and the details of Production Examples are as follows.

Production Examples 1 to 42 are production examples of an aggregate, and Production Examples 43 to 45 are production examples of unvulcanized rubber compositions R-1 to R-3. Production Example 46 is a production example of composite conductive fine particles. Production Example 47 is a production example of surface-treated titanium oxide particles. Production Examples 48 to 94 are production examples of a surface layer coating liquid.

Production Example 1

Production of Aggregate a-1

As a first step, a carbon dioxide-containing gas composed of 25 vol % of carbon dioxide and 75 vol % of air was introduced into 2.0 L of a suspension of magnesium hydroxide (30 g/L) at a speed of 8.0 L/min for 30 minutes while the suspension was stirred with the temperature thereof being kept at 20° C. After that, an insoluble residue was removed to prepare a magnesium hydrogen carbonate solution (pH 7.3).

As a second step following the first step, the pH of the magnesium hydrogen carbonate solution was regulated to 7.7, and the liquid temperature was raised to 55.0° C. by heating. The magnesium hydrogen carbonate solution was stirred for 60 minutes with the temperature being kept to prepare a suspension of magnesium orthocarbonate a'-1 as an intermediate product. The prepared magnesium orthocarbonate a'-1 was observed with a scanning electron microscope (SEM). As a result, columnar particles having an average minor axis of 18.0 μm and an average major axis of 42.3 μm were found to be obtained.

As a third step following the second step, an appropriate amount of a sodium hydroxide aqueous solution was added to the suspension of columnar particles of magnesium orthocarbonate. The pH of the solution was regulated to 10.2, and the liquid temperature was raised to 59.0° C. by heating. After that, the solution was stirred for 120 minutes with the temperature being kept at the same temperature. Thus, a suspension of an aggregate a-1 formed of flaky crystal particles of magnesium carbonate was obtained.

The obtained aggregate was observed with the SEM. As a result, the aggregate was found to be a tubular aggregate having an average minor axis of 20.0 μm, an average inner diameter of 10.0 μm, an average major axis of 42.0 μm, and an aspect ratio of 2.1, formed of flaky crystal particles having an average thickness of 0.5 μm and an average particle diameter of 1.3 μm. Herein, the minor axis refers to the shortest particle diameter in the aggregate, and the major axis refers to the longest particle diameter. Note that, in the case where the aggregate has a tubular shape, the longest diameter in a direction in which a hollow portion extends is defined as a major axis, and a diameter of the aggregate at the center of the major axis is defined as a minor axis.

Production Examples 2 to 37

Production of Aggregates a-2 to a-37

In the production of the aggregate of each production example, the pH and temperature in the second step, and the average minor axis, average major axis, and aspect ratio thereof of the magnesium orthocarbonate a'-1 to a'-37 as intermediate products generated in the second step were shown in Table 1. The pH and temperature in the third step, the average particle diameter and average thickness of flaky crystal particles of magnesium carbonate in the generated aggregates a-1 to a-37, and the average minor axis, average major axis, average inner diameter, and aspect ratio thereof of the aggregates were shown in Table 2. The aggregates a-2 to a-37 were produced by the same method as that of Production Example 1 except for the items shown in Tables 1 and 2. Note that each of the produced aggregates a-2 to a-37 had a tubular shape.

TABLE 1

| Production Example No. | Intermediate product No. | pH | Temperature/° C. | Average minor axis/μm | Average major axis/μm | Aspect ratio |
|---|---|---|---|---|---|---|
| Production Example 1 | a'-1 | 7.7 | 55.0 | 18.0 | 42.3 | 2.4 |
| Production Example 2 | a'-2 | 7.9 | 50.0 | 19.2 | 89.2 | 4.6 |
| Production Example 3 | a'-3 | 8.3 | 30.0 | 19.2 | 184.3 | 9.6 |
| Production Example 4 | a'-4 | 7.7 | 40.0 | 10.5 | 24.2 | 2.3 |
| Production Example 5 | a'-5 | 7.6 | 52.0 | 3.9 | 4.3 | 1.1 |
| Production Example 6 | a'-6 | 7.6 | 38.0 | 28.7 | 34.6 | 1.2 |
| Production Example 7 | a'-7 | 7.7 | 22.0 | 14.8 | 34.8 | 2.4 |
| Production Example 8 | a'-8 | 7.9 | 20.0 | 15.0 | 69.7 | 4.6 |
| Production Example 9 | a'-9 | 7.7 | 55.0 | 18.9 | 47.3 | 2.5 |
| Production Example 10 | a'-10 | 7.9 | 48.0 | 19.2 | 89.2 | 4.6 |
| Production Example 11 | a'-11 | 10.0 | 30.0 | 3.8 | 113.6 | 29.9 |
| Production Example 12 | a'-12 | 7.8 | 65.0 | 9.7 | 11.7 | 1.2 |
| Production Example 13 | a'-13 | 8.3 | 52.0 | 9.8 | 101.8 | 10.4 |
| Production Example 14 | a'-14 | 7.6 | 52.0 | 4.0 | 5.2 | 1.3 |
| Production Example 15 | a'-15 | 8.7 | 48.0 | 3.8 | 56.2 | 14.8 |
| Production Example 16 | a'-16 | 7.7 | 40.0 | 9.9 | 22.8 | 2.3 |
| Production Example 17 | a'-17 | 7.7 | 40.0 | 10.2 | 23.5 | 2.3 |
| Production Example 18 | a'-18 | 7.7 | 40.0 | 9.8 | 23.5 | 2.4 |
| Production Example 19 | a'-19 | 7.7 | 40.0 | 9.9 | 21.8 | 2.2 |
| Production Example 20 | a'-20 | 7.7 | 40.0 | 10.1 | 25.3 | 2.5 |
| Production Example 21 | a'-21 | 7.7 | 40.0 | 9.7 | 23.3 | 2.4 |
| Production Example 22 | a'-22 | 7.7 | 40.0 | 10.2 | 23.5 | 2.3 |
| Production Example 23 | a'-23 | 7.7 | 40.0 | 10.1 | 24.2 | 2.4 |
| Production Example 24 | a'-24 | 7.7 | 40.0 | 9.9 | 23.8 | 2.4 |
| Production Example 25 | a'-25 | 7.7 | 40.0 | 9.8 | 24.5 | 2.5 |
| Production Example 26 | a'-26 | 7.7 | 40.0 | 10.0 | 23.0 | 2.3 |
| Production Example 27 | a'-27 | 7.7 | 53.0 | 1.0 | 1.1 | 1.1 |
| Production Example 28 | a'-28 | 7.6 | 52.0 | 3.8 | 4.2 | 1.1 |
| Production Example 29 | a'-29 | 7.6 | 38.0 | 28.9 | 37.6 | 1.3 |

TABLE 1-continued

| Production Example No. | Intermediate product No. | pH | Temperature/° C. | Average minor axis/μm | Average major axis/μm | Aspect ratio |
|---|---|---|---|---|---|---|
| Production Example 30 | a'-30 | 7.5 | 18.0 | 39.7 | 47.8 | 1.2 |
| Production Example 31 | a'-31 | 11.0 | 15.0 | 3.8 | 187.7 | 49.4 |
| Production Example 32 | a'-32 | 7.7 | 40.0 | 10.2 | 25.5 | 2.5 |
| Production Example 33 | a'-33 | 7.7 | 40.0 | 9.7 | 22.8 | 2.4 |
| Production Example 34 | a'-34 | 7.7 | 40.0 | 9.8 | 23.0 | 2.4 |
| Production Example 35 | a'-35 | 7.7 | 40.0 | 9.8 | 22.5 | 2.3 |
| Production Example 36 | a'-36 | 7.7 | 40.0 | 9.7 | 22.8 | 2.4 |
| Production Example 37 | a'-37 | 7.7 | 40.0 | 10.1 | 23.2 | 2.3 |

Production Example 38

Production of Aggregate a-38

Carbon dioxide was introduced into 2.0 L of a suspension of magnesium hydroxide (30 g/L) regulated to 60° C. at a speed of 1.5 L/min for 240 minutes while the suspension was stirred with the temperature thereof being kept at 63° C. to generate magnesium carbonate. The obtained product was washed with ion-exchanged water and ethanol, and dried. After that, the obtained product was observed with the SEM. As a result, the product was found to be a spherical aggregate of magnesium carbonate having an average particle diameter of 20.0 μm, the aggregate being formed of flaky crystal particles having an average thickness of 0.5 μm and an average particle diameter of 1.0 μm.

Production Example 39

Production of Aggregate a-39

Carbon dioxide was introduced into 2.0 L of a suspension of calcium hydroxide (30 g/L) regulated to 60° C. at a speed of 1.5 L/min for 240 minutes while the suspension was stirred with the temperature thereof being kept at 63° C. to generate calcium carbonate. The obtained product was washed with ion-exchanged water and ethanol, and dried. After that, the obtained product was observed with the SEM. As a result, the product was found to be a spherical aggregate of calcium carbonate having an average particle diameter of 20.0 μm, the aggregate being formed of flaky crystal particles having an average thickness of 0.5 μm and an average particle diameter of 1.0 μm.

Production Example 40

Production of Aggregate a-40

As a first step, 0.45 L of an aqueous solution magnesium chloride hexahydrate (410 g/L) was gradually added to 2.0 L of an aqueous solution sodium carbonate (55 g/L) regulated to 30° C. with the temperature being kept at 30° C., and the mixture was stirred for 90 minutes to obtain magnesium orthocarbonate as an intermediate product. The obtained magnesium orthocarbonate was observed with the SEM. As a result, columnar particles having an average minor axis of 6 μm and an average major axis of 60 μm were found to be obtained. A suspension of the magnesium orthocarbonate was filtered, and a solid content was washed with ion-exchanged water. Then, the resultant was dispersed again in 2.0 L of ion-exchanged water to prepare a suspension of the magnesium orthocarbonate from which sodium chloride as a reaction by-product was removed.

As a second step following the first step, the suspension (pH 9.0) of columnar particles of the magnesium orthocarbonate obtained in the first step was heated, and stirred for 120 minutes with the temperature thereof being kept at 60° C. to generate magnesium carbonate. The obtained product was dried and observed with the SEM. As a result, the product was found to be a columnar magnesium carbonate aggregate having an average minor axis of 20.0 μm and an average major axis of 40.0 μm, the aggregate being formed of flaky crystal particles having an average thickness of 0.5 μm and an average major axis of 1.0 μm.

Production Example 41

Production of Aggregate a-41

An aggregate was produced in the same way as in Production Example 1 except for, as the second step, adding a suspension in which 12 g of titanium oxide ("CR-63" (trade name) manufactured by Ishihara Sangyo Kaisha, Ltd.) were ultrasonically dispersed in 240 mL of ion-exchanged water to the solution magnesium hydrogen carbonate produced in the first step. The produced aggregate was observed with the SEM. As a result, the aggregate was found to be a tubular aggregate having an average minor axis of 22.0 μm, an average inner diameter of 9.0 μm, and an average major axis of 40.0 μm, the aggregate containing flaky crystal particles having an average thickness of 0.49 μm and an average particle diameter of 1.2 μm. Further, the aggregate was observed with a transmission electron microscope (TEM). As a result, titanium oxide particles having a particle diameter of 0.2 μm were found to be immobilized and complexed in the aggregate.

Production Example 42

Production of Aggregate a-42

An aggregate a-42 was obtained in the same way as in Production Example 1 except for changing the reaction time to 70 minutes in the third step. The aggregate was observed with the SEM. As a result, the aggregate was found to be a tubular aggregate having an average minor axis of 19.0 μm, an average inner diameter of 9.0 μm, and an average major axis of 41.0 μm, the aggregate being formed of flaky crystal particles having an average thickness of 0.5 μm and an average particle diameter of 1.3 μm.

TABLE 2

| | | | | Flaky crystal particles | | | Aggregate | | | |
|---|---|---|---|---|---|---|---|---|---|---|
| Production Example No. | Aggregate No. | pH | Temperature/ ° C. | Average particle diameter/ μm | Average thickness/ μm | Average particle diameter/ average thickness | Average minor axis/μm | Average inner diameter/ μm | Average major axis/μm | Aspect ratio |
| Production Example 1 | a-1 | 10.2 | 59.0 | 1.3 | 0.5 | 2.7 | 20.0 | 10.0 | 42.0 | 2.1 |
| Production Example 2 | a-2 | 10.2 | 59.0 | 1.3 | 0.48 | 2.8 | 21.0 | 10.3 | 86.1 | 4.1 |
| Production Example 3 | a-3 | 10.2 | 59.0 | 1.3 | 0.49 | 2.8 | 20.2 | 9.7 | 204.0 | 10.1 |
| Production Example 4 | a-4 | 10.2 | 59.0 | 1.2 | 0.49 | 2.4 | 10.3 | 5.0 | 22.7 | 2.2 |
| Production Example 5 | a-5 | 10.2 | 59.0 | 1.1 | 0.51 | 2.2 | 4.1 | 1.6 | 4.9 | 1.2 |
| Production Example 6 | a-6 | 10.2 | 59.0 | 1.3 | 0.51 | 2.6 | 31.0 | 17.7 | 34.1 | 1.1 |
| Production Example 7 | a-7 | 10.2 | 59.0 | 1.2 | 0.5 | 2.4 | 14.6 | 7.4 | 30.7 | 2.1 |
| Production Example 8 | a-8 | 10.2 | 59.0 | 1.2 | 0.5 | 2.4 | 15.1 | 7.9 | 63.4 | 4.2 |
| Production Example 9 | a-9 | 10.2 | 59.0 | 1.2 | 0.49 | 2.4 | 22.3 | 12.0 | 44.6 | 2.0 |
| Production Example 10 | a-10 | 10.2 | 59.0 | 1.3 | 0.49 | 2.8 | 20.1 | 11.1 | 82.4 | 4.1 |
| Production Example 11 | a-11 | 10.2 | 59.0 | 1.3 | 0.51 | 2.5 | 4.2 | 1.6 | 127.3 | 30.3 |
| Production Example 12 | a-12 | 10.2 | 59.0 | 1.1 | 0.49 | 2.2 | 11.2 | 5.5 | 12.3 | 1.1 |
| Production Example 13 | a-13 | 10.2 | 59.0 | 1.4 | 0.48 | 2.9 | 10.3 | 5.2 | 105.1 | 10.2 |
| Production Example 14 | a-14 | 10.2 | 59.0 | 1.4 | 0.5 | 2.8 | 3.9 | 1.5 | 4.3 | 1.1 |
| Production Example 15 | a-15 | 10.2 | 59.0 | 1.3 | 0.51 | 2.6 | 4.2 | 1.7 | 63.8 | 15.2 |
| Production Example 16 | a-16 | 10.7 | 40.0 | 0.1 | 0.005 | 18.8 | 10.2 | 5.0 | 22.4 | 2.2 |
| Production Example 17 | a-17 | 9.7 | 42.0 | 1.1 | 0.9 | 1.2 | 10.0 | 4.8 | 23.0 | 2.3 |
| Production Example 18 | a-18 | 10.2 | 59.0 | 1.3 | 0.51 | 2.6 | 10.0 | 5.0 | 20.0 | 2.0 |
| Production Example 19 | a-19 | 10.2 | 68.0 | 2.0 | 0.51 | 3.8 | 10.3 | 5.2 | 19.6 | 1.9 |
| Production Example 20 | a-20 | 10.7 | 54.0 | 1.0 | 0.05 | 20.4 | 10.2 | 5.2 | 19.4 | 1.9 |
| Production Example 21 | a-21 | 10.7 | 40.0 | 0.1 | 0.005 | 18.8 | 10.2 | 5.3 | 21.4 | 2.1 |
| Production Example 22 | a-22 | 10.7 | 61.0 | 1.5 | 0.12 | 12.2 | 10.3 | 5.3 | 20.6 | 2.0 |
| Production Example 23 | a-23 | 9.7 | 47.0 | 2.3 | 1.2 | 1.9 | 10.4 | 5.2 | 22.9 | 2.2 |
| Production Example 24 | a-24 | 9.7 | 47.0 | 2.2 | 1.1 | 2.0 | 10.2 | 4.9 | 23.5 | 2.3 |
| Production Example 25 | a-25 | 10.7 | 40.0 | 0.1 | 0.005 | 18.8 | 10.3 | 5.0 | 20.6 | 2.0 |
| Production Example 26 | a-26 | 9.7 | 47.0 | 2.3 | 0.98 | 2.4 | 10.1 | 4.9 | 21.2 | 2.1 |
| Production Example 27 | a-27 | 10.2 | 59.0 | 1.4 | 0.48 | 2.9 | 1.0 | 0.4 | 1.1 | 1.1 |
| Production Example 28 | a-28 | 10.2 | 59.0 | 1.2 | 0.49 | 2.4 | 4.1 | 1.6 | 3.3 | 0.8 |
| Production Example 29 | a-29 | 10.2 | 59.0 | 1.2 | 0.52 | 2.3 | 30.4 | 18.8 | 24.3 | 0.8 |
| Production Example 30 | a-30 | 10.2 | 59.0 | 1.4 | 0.51 | 2.7 | 40.2 | 25.7 | 48.2 | 1.2 |
| Production Example 31 | a-31 | 10.2 | 59.0 | 1.3 | 0.5 | 2.7 | 3.8 | 1.4 | 190.4 | 50.1 |
| Production Example 32 | a-32 | 10.7 | 39.0 | 0.03 | 0.005 | 6.0 | 10.2 | 4.9 | 21.4 | 2.1 |
| Production Example 33 | a-33 | 10.7 | 40.0 | 0.1 | 0.003 | 31.4 | 10.3 | 4.8 | 20.6 | 2.0 |
| Production Example 34 | a-34 | 9.7 | 43.0 | 1.2 | 1.1 | 1.1 | 10.1 | 5.1 | 20.2 | 2.0 |
| Production Example 35 | a-35 | 9.7 | 60.0 | 5.7 | 2.1 | 2.7 | 10.1 | 5.1 | 22.2 | 2.2 |
| Production Example 36 | a-36 | 9.2 | 50.0 | 4.5 | 0.9 | 5.0 | 10.1 | 5.2 | 23.2 | 2.3 |

TABLE 2-continued

| Production Example No. | Aggregate No. | pH | Temperature/ ° C. | Flaky crystal particles: Average particle diameter/ μm | Average thickness/ μm | Average particle diameter/ average thickness | Aggregate: Average minor axis/μm | Average inner diameter/ μm | Average major axis/μm | Aspect ratio |
|---|---|---|---|---|---|---|---|---|---|---|
| Production Example 37 | a-37 | 9.0 | 55.0 | 10.9 | 2.1 | 5.2 | 10.2 | 4.9 | 21.4 | 2.1 |
| Production Example 38 | a-38 | — | — | 1.0 | 0.5 | 2.0 | 20.0 | — | 20.0 | 1.0 |
| Production Example 39 | a-39 | — | — | 1.0 | 0.5 | 2.0 | 20.0 | — | 20.0 | 1.0 |
| Production Example 40 | a-40 | — | — | 1.0 | 0.5 | 2.0 | 20.0 | — | 40.0 | 2.0 |
| Production Example 41 | a-41 | 10.2 | 59.0 | 1.2 | 0.49 | 2.4 | 22.0 | 9.0 | 40.0 | 1.8 |
| Production Example 42 | a-42 | 10.2 | 59.0 | 1.3 | 0.5 | 2.6 | 19.0 | 9.0 | 41.0 | 2.2 |

Production Example 43

Production of Unvulcanized Rubber Composition R-1 Using Epichlorohydrin Rubber The following 7 components were added to 100 parts by mass of epichlorohydrin rubber (ethylene oxide (EO)-epichlorohydrin (EP)-allyl glycidyl ether (AGE) ternary copolymer, EO/EP/AGE=73 mol %/23 mol %/4 mol %). The mixture was kneaded for 10 minutes with a closed mixer regulated to 50° C.

TABLE 3

| | |
|---|---|
| Calcium carbonate | 60 Parts by mass |
| Aliphatic polyester-based plasticizer | 5 Parts by mass |
| Zinc stearate | 1 Part by mass |
| 2-Mercaptobenzimidazole (MB) (antioxidant) | 0.5 Part by mass |
| Zinc oxide | 5 Parts by mass |
| Quaternary ammonium salt ("ADK CIZER LV70" (trade name) manufactured by Adeka Corporation) | 2 Parts by mass |
| Carbon black ("Thermax Floform N990" (trade name) manufactured by Cancarb Limited, Canada) | 5 Parts by mass |

Next, the following components were added to the mixture.

Sulfur (vulcanizing agent): 1.2 parts by mass

Dibenzothiazyl disulfide ("NOCCELER DM" (trade name) manufactured by OUCHI SHINKO CHEMICAL INDUSTRIAL CO., LTD.) (vulcanization accelerator): 1 part by mass Tetramethylthiuram monosulfide ("NOCCELER TS" (trade name) manufactured by OUCHI SHINKO CHEMICAL INDUSTRIAL CO., LTD.): 1 part by mass The resultant mixture was kneaded for 10 minutes with a two-roll mill cooled to a temperature of 20° C., thereby producing an unvulcanized rubber composition R-1.

Production Example 44

Production of Unvulcanized Rubber Composition R-2 Using Acrylonitrile Butadiene Rubber Four components shown in Table 4 below were added to 100 parts by mass of acrylonitrile butadiene rubber (NBR) ("N230SV" (trade name) manufactured by JSR Corporation). The mixture was kneaded for 15 minutes with a closed mixer regulated to 50° C.

TABLE 4

| | |
|---|---|
| Carbon black ("TOKABLACK #7360SB" (trade name) manufactured by Tokai Carbon Co., Ltd.) | 48 Parts by mass |
| Zinc stearate ("SZ-2000" (trade name) manufactured by Sakai Chemical Industry Co., Ltd.) | 1 Part by mass |
| Zinc oxide ("Zinc white type 2" (trade name) manufactured by Sakai Chemical Industry Co., Ltd.) | 5 Parts by mass |
| Calcium carbonate ("Silver W" (trade name) manufactured by Shiraishi Kogyo Kaisha, Ltd.) | 20 Parts by mass |

Next, the following components were added to the mixture.

Sulfur (vulcanizing agent): 1.2 parts by mass

Tetrabenzylthiuram disulfide (TBzTD) ("Perkacit TBzTD" (trade name) manufactured by Flexis S.A.) (vulcanization accelerator): 4.5 parts by mass The resultant mixture was kneaded for 10 minutes with a two-roll mill cooled to a temperature of 25° C., thereby producing an unvulcanized rubber composition R-2.

Production Example 45

Production of Unvulcanized Rubber Composition R-3 Using Styrene-Butadiene Rubber Components in Table 5 below were added to 100 parts by mass of styrene-butadiene rubber (SBR) ("SBR1500" (trade name) manufactured by JSR Corporation), and the mixture was kneaded with a closed mixer regulated to 80° C. for 15 minutes.

TABLE 5

| | |
|---|---|
| Zinc oxide ("Zinc white type 2" (trade name) manufactured by Sakai Chemical Industry Co., Ltd.) | 5 Parts by mass |
| Zinc stearate ("SZ-2000" (trade name) manufactured by Sakai Chemical Industry Co., Ltd.) | 2 Parts by mass |
| Carbon black ("KETJENBLACK EC600JD" (trade name) manufactured by Lion Corporation) | 8 Parts by mass |
| Carbon black ("SEAST S" (trade name) manufactured by Tokai Carbon Co., Ltd.) | 40 Parts by mass |
| Calcium carbonate ("Silver W" (trade name) manufactured by Shiraishi Kogyo Kaisha, Ltd.) | 15 Parts by mass |
| Paraffin oil ("PW380" (trade name) manufactured by Idemitsu Kosan Co., Ltd.) | 20 Parts by mass |

Then, 1 part by mass of sulfur as a vulcanizing agent, and 1 part by mass of dibenzothiazyl disulfide ("NOCCELER DM" (trade name) manufactured by Ouchi Shinko Chemical Industrial Co., Ltd.) and 1 part by mass of tetramethylthiuram monosulfide ("NOCCELER TS" (trade name) manufactured by Ouchi Shinko Chemical Industrial Co., Ltd.) as vulcanization accelerators were added to the mixture. Then, the resultant mixture was kneaded with a two-roll mill cooled to 25° C. for 10 minutes to obtain an unvulcanized rubber composition R-3.

Production Example 46

Production of Composite Conductive Fine Particles 140 g of methyl hydrogen polysiloxane were added to 7.0 kg of silica particles (average particle diameter: 15 nm, volume resistivity: $1.8\times10^{12}$ Ω·cm) while an edge runner was being operated, and the resultant was mixed and stirred for 30 minutes under a line load of 588 N/cm (60 kg/cm). The stirring speed at this time was 22 rpm. Then, 7.0 kg of carbon black ("#52" (trade name) manufactured by Mitsubishi Chemical Corporation) were added to the resultant over 10 minutes while the edge runner was being operated. The resultant was further mixed and stirred for 60 minutes under a line load of 588 N/cm (60 kg/cm).

Carbon black was caused to adhere to surfaces of the silica particles thus covered with methyl hydrogen polysiloxane, and then, the resultant was dried at 80° C. for 60 minutes through use of a drier to produce composite conductive fine particles. The stirring speed at this time was 22 rpm. Note that the obtained composite conductive fine particles had an average particle diameter of 15 nm, and a volume resistivity of $1.1\times10^{2}$ Ω·cm.

Production Example 47

Production of Surface-Treated Titanium Oxide Particles 110 g of isobutyltrimethoxysilane as a surface treatment agent and 3,000 g of toluene as a solvent were blended with 1,000 g of needle-shaped rutile-type titanium oxide particles (average particle diameter: 15 nm, height:width=3:1, volume resistivity: $2.3\times10^{10}$ Ω·cm) to prepare a slurry. The slurry was mixed for 30 minutes with a stirrer. After that, the resultant was supplied to a viscomill whose 80 vol % of an effective inner volume were filled with glass beads having an average particle diameter of 0.8 mm and subjected to wet-type crushing treatment at a temperature of 35±5° C.

The slurry obtained by the wet-type crushing treatment was subjected to distillation under reduced pressure (bath temperature: 110° C., product temperature: 30 to 60° C., pressure reduction degree: about 100 Torr) through use of a kneader to remove toluene, and the baking treatment of the surface treatment agent was performed at 120° C. for 2 hours. The particles obtained by the baking treatment were cooled to room temperature and pulverized through use of a pin mill to produce surface-treated titanium oxide particles.

Production Example 48

Production of Surface Layer Coating Liquid A-1

Methyl isobutyl ketone was added to a solution of caprolactone-modified acryl polyol ("Placcel DC2016" (trade name) manufactured by Daicel Chemical Industries, Ltd.) so that a solid content became 4 mass %. Four components in Table 6 below were added to the resultant solution (100 parts by mass of an acryl polyol solid content) to prepare a mixed solution.

TABLE 6

| | |
|---|---|
| Composite conductive fine particles (particles produced in Production Example 46) | 35 Parts by mass |
| Surface-treated titanium oxide particles (particles produced in Production Example 47) | 15 Parts by mass |
| Modified dimethylsilicone oil (*1) | 0.08 Part by mass |
| Blocked isocyanate mixture (*2) | 80.14 Parts by mass |

In this case, the blocked isocyanate mixture had an isocyanate amount satisfying a relationship of "NCO/OH=1.0".

(*1) Modified dimethylsilicone oil ("SH28PA" (trade name) manufactured by Dow Corning Toray Silicone Co., Ltd.)

(*2) 7:3 Mixture of butanone oxime-blocked products of hexamethylene diisocyanate (HDI) and isophorone diisocyanate (IPDI)

200 g of the mixed solution were supplied to a glass bottle having an inner volume of 450 mL together with 200 g of glass beads having an average particle diameter of 0.8 mm as a medium. The resultant was pre-dispersed for 24 hours through use of a paint shaker disperser to produce a surface layer pre-dispersion liquid A. After that, the glass beads were removed, and 20 parts by mass of the aggregate a-1 were added to 100 parts by mass of the acryl polyol solid content in the surface layer pre-dispersion liquid A. The resultant was dispersed for 5 minutes to produce a surface layer coating liquid A-1.

Production Examples 49 to 90

Production of Surface Layer Coating Liquids A-2 to A-43

Surface layer coating liquids A-2 to A-43 were produced in the same way as in Production Example 48 except for changing the kind of an aggregate and the number of added parts to the conditions shown in Table 12.

Production Example 91

Production of Surface Layer Coating Liquid B-1

Four components in Table 7 below were added to 100 parts by mass of N-methoxymethylated nylon to prepare a mixed solution.

TABLE 7

| | |
|---|---|
| Carbon black ("KETJENBLACK EC600JD" (trade name) manufactured by Lion Corporation) | 12 Parts by mass |
| Methanol | 250 Parts by mass |
| Toluene | 140 Parts by mass |
| Citric acid | 2 Parts by mass |

The mixed solution was dispersed for 24 hours through use of a paint shaker disperser in the same way as in Production Example 35 to produce a surface layer predispersion liquid B. After that, 20 parts by mass of the aggregate a-2 were added to 100 parts by mass of N-methoxymethylated nylon in the surface layer predispersion liquid B. The resultant was dispersed for 5 minutes to obtain a surface layer coating liquid B-1.

Production Examples 92 and 93

Production of Surface Layer Coating Liquids B-2 and B-3

Surface layer coating liquids B-2 and B-3 were produced in the same way as in Production Example 91 except for changing the kind of an aggregate and the number of added parts to the conditions shown in Table 12.

Production Example 94

Production of Surface Layer Coating Liquid C-1

Two components in Table 8 below were added to 100 parts by mass of an acrylic resin ("SP-1350" (trade name) manufactured by TOA GOSEI CO., LTD.) to prepare a mixed solution.

TABLE 8

| | |
|---|---|
| Carbon black ("KETJENBLACK EC600JD" (trade name) manufactured by Lion Corporation) | 12 Parts by mass |
| Toluene | 100 Parts by mass |

The above-mentioned mixed solution was dispersed for 7 hours through use of a paint shaker disperser in the same way as in Production Example 35 to produce a surface layer pre-dispersion liquid C. After that, 20 parts by mass of the aggregate a-2 were added to 100 parts by mass of the acrylic resin in the surface layer pre-dispersion liquid C. The resultant was dispersed for 5 minutes to obtain a surface layer coating liquid C-1.

Example 1

Electroconductive Substrate

A thermosetting adhesive containing 10 mass % of carbon black was applied to a substrate made of stainless steel having a diameter of 6 mm and a length of 252.5 mm and dried. The resultant substrate was used as an electroconductive substrate.

(Conductive Elastic Layer)

An electroconductive substrate serving as a central axis was covered with the unvulcanized rubber composition R-1 produced in Production Example 42 coaxially and cylindrically through use of an extrusion molding machine equipped with a cross-head to obtain a preform having an outer diameter of 10.0 mm.

The preform was heated and vulcanized at 160° C. for 1 hour in a hot-air oven to form a conductive elastic layer on the outer circumference of the electroconductive substrate. Ends of the conductive elastic layer were removed to obtain a roller having the conductive elastic layer with a length of 224.2 mm.

Then, the outer circumferential surface of the conductive elastic layer was polished through use of a plunge-cutting type cylindrical polishing machine. As a result of the operation, an elastic roller D-1 having a conductive elastic layer with an outer diameter of 8.5 mm, a length of 224.2 mm, and a crown amount of 170 μm, which is a difference between the outer diameter in a central portion and the outer diameter at a position away from the central portion by 90 mm, was obtained.

(Formation of Surface Layer)

The surface layer coating liquid A-1 produced in Production Example 48 was applied to the elastic roller D-1 once by dip coating. After the application, the surface layer coating liquid A-1 was dried with air at normal temperature for 30 minutes or more and dried at 80° C. for 1 hour and further at 160° C. for 1 hour in a hot-air circulation drier. A charging roller T-1 such as an electrophotographic member having a surface layer formed thereon was obtained by the above-mentioned method. Note that the dip coating was performed under the following conditions: the soaking time was set to 9 seconds; the initial lifting speed was 20 mm/s; the final lifting speed was 2 mm/s; and the lifting speed was changed between the initial speed and the final speed linearly with respect to time.

As physical properties of the produced charging roller T-1, the average particle diameter, average thickness, ratio of the average particle diameter with respect to the average thickness, and card house structure unevenness interval of flaky crystal particles of an aggregate were evaluated by the above-mentioned method. As physical properties of the charging roller, the ten-point average surface roughness Rz and dynamic friction coefficient of the charging roller were evaluated by the above-mentioned method. Table 12 shows the evaluation results.

(Durability Evaluation)

Figure 8:
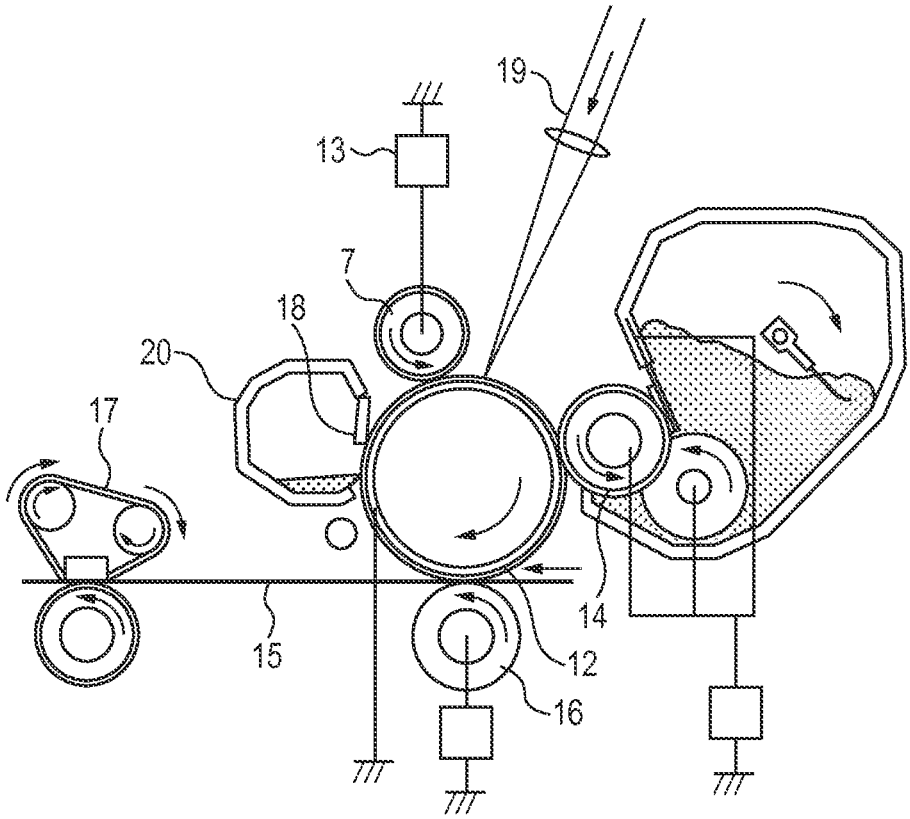
FIG. 8 is a schematic sectional view illustrating an example of an electrophotographic apparatus according to the present invention.

As an electrophotographic apparatus having a configuration illustrated in FIG. 8, a color laser printer ("Satera LBP5400" (trade name) manufactured by Canon Inc.) was remodeled and used so as to output recorded media at 200 mm/sec (A4 vertical output). The resolution of an image was 600 dpi, and the output of primary charging was a DC voltage of −1,100 V. An image was output with a resolution of 600 dpi. As a process cartridge, a black process cartridge for the above-mentioned printer was used.

Note that the electrophotographic apparatus illustrated in FIG. 8 includes an electrophotographic photosensitive member 12, a charging device including a charging roller 7 and a power source 13 for charging the charging roller 7, a latent image forming device 19 for forming an electrostatic latent image on the electrophotographic photosensitive member 12 by performing light exposure in accordance with image information, a developing device 14 for developing the electrostatic latent image with toner, a transferring device 16 for transferring the formed toner image onto a transfer material 15, a cleaning device including a cleaning member 18 and a collection container 20, for collecting the transferred toner on the electrophotographic photosensitive member, and a fixing device 17 for fixing a toner image.

Figure 9:
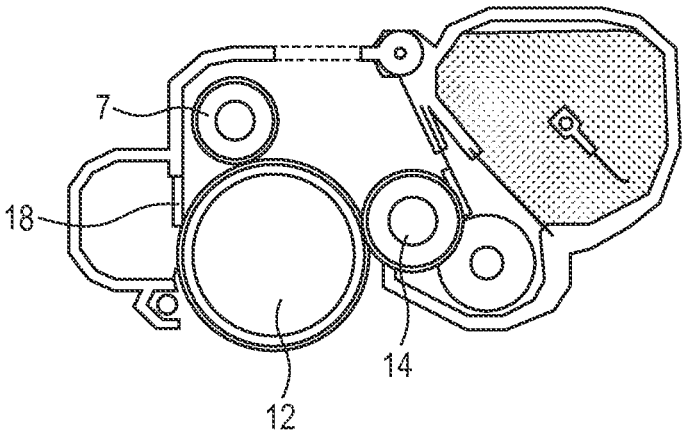
FIG. 9 is a schematic sectional view illustrating an example of a process cartridge according to the present invention.

FIG. 9 illustrates an example of a process cartridge. As illustrated in FIG. 9, the process cartridge includes the electrophotographic photosensitive member 12, the charging roller 7, the developing device 14, the cleaning member 18, and the like integrated with each other, and is removably mounted onto a main body of the electrophotographic apparatus.

The accompanying charging roller was removed from the process cartridge, and the produced charging roller T-1 was set. The process cartridge was held in an environment at a temperature of 15° C. and a humidity of 10% RH (environment 1) for 24 hours. After that, durability was evaluated in each environment. Specifically, for an E-character image with a printing density of 1%, a two-sheet intermittent durability test (printing was stopped for 3 seconds every time two sheets are printed) was performed at a process speed of 200 mm/sec.

In the environment 1, 1,000 sheets, 10,000 sheets, and 20,000 sheets of images were printed, and thereafter, each half-tone image was output. Then, a half-tone image (image drawing horizontal lines with a width of 1 dot and an interval of 2 dots in a direction perpendicular to a rotation direction of the electrophotographic photosensitive member) was output. The obtained image was visually observed, and a banding image, which was horizontal stripe density unevenness caused by uneven charging described above, was determined based on the criteria shown in Table 9. Table 13 shows the evaluation results.

TABLE 9

| | |
|---|---|
| Rank 1 | No banding image occurs. |
| Rank 2 | Only a slight banding image is recognized. |
| Rank 3 | Although a banding image is confirmed partially at a pitch of a charging roller, there are no problems in practical images. |
| Rank 4 | A banding image is conspicuous, and degradation in image quality is recognized. |

Examples 2 to 47

The kind of each unvulcanized rubber composition and the kind of each surface layer coating liquid were changed as shown in Table 11. Further, each surface layer coating liquid was dried after being applied under the conditions shown in Table 10.

TABLE 10

| | |
|---|---|
| Surface layer coating liquid A-1 to A-44 | Dried with air at normal temperature for 30 minutes or more, and thereafter heated at 80° C. for 1 hour, further at 160° C. for 1 hour in a hot-air circulation drier. |
| Surface layer coating liquid B-1 | Dried with air at normal temperature for 30 minutes or more, and thereafter heated at 150° C. for 1 hour in a hot-air circulation drier. |
| Surface layer coating liquid C-1 | Dried with air at normal temperature for 1 hour or more, and thereafter heated at 150° C. for 1 hour in a hot-air circulation drier. |

Charging rollers T-2 to T-47 were produced in the same way as in Example 1 except for the foregoing. Tables 12 and 13 show the evaluation results.

Comparative Example 1

A charging roller T-48 was produced in the same way as in Example 1 except for using acrylic resin particles ("MR-50G" (trade name) manufactured by Soken Chemical Engineering Co., Ltd.) having a volume average particle diameter of 50 μm in place of the aggregate, setting the number of added parts to 20 parts by mass, and using the unvulcanized rubber composition R-2 for the conductive elastic layer. Tables 12 and 13 show the evaluation results.

TABLE 11

| | | Elastic layer | | Surface layer | | | | | |
|---|---|---|---|---|---|---|---|---|---|
| Example No. | Charging roller No. | Elastic layer production example No. | Unvulcanized rubber composition | Surface layer production example No. | Surface layer coating liquid No. | Surface layer pre-dispersion liquid | Binder resin | Aggregate No. | Number of added parts of aggregate/parts by mass |
| Example 1 | T-1 | Production Example 43 | R-1 | Production Example 48 | A-1 | A | Urethane resin | a-1 | 20 |
| Example 2 | T-2 | Production Example 43 | R-1 | Production Example 49 | A-2 | A | Urethane resin | a-41 | 20 |
| Example 3 | T-3 | Production Example 43 | R-1 | Production Example 50 | A-3 | A | Urethane resin | a-2 | 20 |
| Example 4 | T-4 | Production Example 43 | R-1 | Production Example 51 | A-4 | A | Urethane resin | a-3 | 20 |
| Example 5 | T-5 | Production Example 43 | R-1 | Production Example 52 | A-5 | A | Urethane resin | a-38 | 20 |
| Example 6 | T-6 | Production Example 43 | R-1 | Production Example 53 | A-6 | A | Urethane resin | a-39 | 20 |
| Example 7 | T-7 | Production Example 43 | R-1 | Production Example 54 | A-7 | A | Urethane resin | a-40 | 20 |
| Example 8 | T-8 | Production Example 43 | R-1 | Production Example 55 | A-8 | A | Urethane resin | a-4 | 20 |
| Example 9 | T-9 | Production Example 43 | R-1 | Production Example 91 | B-1 | B | Acrylic resin | a-2 | 20 |
| Example 10 | T-10 | Production Example 43 | R-1 | Production Example 94 | C-1 | C | Amide resin | a-2 | 20 |
| Example 11 | T-11 | Production Example 44 | R-2 | Production Example 56 | A-9 | A | Urethane resin | a-2 | 20 |
| Example 12 | T-12 | Production Example 43 | R-1 | Production Example 57 | A-10 | A | Urethane resin | a-2 | 40 |
| Example 13 | T-13 | Production Example 43 | R-1 | Production Example 58 | A-11 | A | Urethane resin | a-2 | 60 |
| Example 14 | T-14 | Production Example 43 | R-1 | Production Example 59 | A-12 | A | Urethane resin | a-5 | 20 |
| Example 15 | T-15 | Production Example 43 | R-1 | Production Example 60 | A-13 | A | Urethane resin | a-6 | 20 |
| Example 16 | T-16 | Production Example 43 | R-1 | Production Example 61 | A-14 | A | Urethane resin | a-7 | 20 |
| Example 17 | T-17 | Production Example 43 | R-1 | Production Example 62 | A-15 | A | Urethane resin | a-8 | 20 |
| Example 18 | T-18 | Production Example 43 | R-1 | Production Example 63 | A-16 | A | Urethane resin | a-9 | 20 |

TABLE 11-continued

| | | Elastic layer | | Surface layer | | | | | |
|---|---|---|---|---|---|---|---|---|---|
| Example No. | Charging roller No. | Elastic layer production example No. | Unvulcanized rubber composition | Surface layer production example No. | Surface layer coating liquid No. | Surface layer pre-dispersion liquid | Binder resin | Aggregate No. | Number of added parts of aggregate/parts by mass |
| Example 19 | T-19 | Production Example 43 | R-1 | Production Example 64 | A-17 | A | Urethane resin | a-10 | 20 |
| Example 20 | T-20 | Production Example 43 | R-1 | Production Example 65 | A-18 | A | Urethane resin | a-11 | 20 |
| Example 21 | T-21 | Production Example 43 | R-1 | Production Example 66 | A-19 | A | Urethane resin | a-12 | 20 |
| Example 22 | T-22 | Production Example 43 | R-1 | Production Example 67 | A-20 | A | Urethane resin | a-13 | 20 |
| Example 23 | T-23 | Production Example 43 | R-1 | Production Example 68 | A-21 | A | Urethane resin | a-14 | 20 |
| Example 24 | T-24 | Production Example 43 | R-1 | Production Example 69 | A-22 | A | Urethane resin | a-15 | 20 |
| Example 25 | T-25 | Production Example 43 | R-1 | Production Example 70 | A-23 | A | Urethane resin | a-16 | 20 |
| Example 26 | T-26 | Production Example 43 | R-1 | Production Example 71 | A-24 | A | Urethane resin | a-17 | 20 |
| Example 27 | T-27 | Production Example 43 | R-1 | Production Example 72 | A-25 | A | Urethane resin | a-18 | 20 |
| Example 28 | T-28 | Production Example 43 | R-1 | Production Example 73 | A-26 | A | Urethane resin | a-19 | 20 |
| Example 29 | T-29 | Production Example 43 | R-1 | Production Example 74 | A-27 | A | Urethane resin | a-20 | 20 |
| Example 30 | T-30 | Production Example 43 | R-1 | Production Example 75 | A-28 | A | Urethane resin | a-21 | 20 |
| Example 31 | T-31 | Production Example 43 | R-1 | Production Example 76 | A-29 | A | Urethane resin | a-22 | 20 |
| Example 32 | T-32 | Production Example 43 | R-1 | Production Example 77 | A-30 | A | Urethane resin | a-23 | 20 |
| Example 33 | T-33 | Production Example 43 | R-1 | Production Example 78 | A-31 | A | Urethane resin | a-24 | 20 |
| Example 34 | T-34 | Production Example 43 | R-1 | Production Example 79 | A-32 | A | Urethane resin | a-25 | 20 |
| Example 35 | T-35 | Production Example 43 | R-1 | Production Example 80 | A-33 | A | Urethane resin | a-26 | 20 |
| Example 36 | T-36 | Production Example 43 | R-1 | Production Example 81 | A-34 | A | Urethane resin | a-27 | 20 |
| Example 37 | T-37 | Production Example 43 | R-1 | Production Example 92 | B-2 | B | Acrylic resin | a-28 | 20 |
| Example 38 | T-38 | Production Example 44 | R-2 | Production Example 82 | A-35 | A | Urethane resin | a-29 | 20 |
| Example 39 | T-39 | Production Example 43 | R-1 | Production Example 83 | A-36 | A | Urethane resin | a-30 | 20 |
| Example 40 | T-40 | Production Example 43 | R-1 | Production Example 84 | A-37 | A | Urethane resin | a-31 | 20 |
| Example 41 | T-41 | Production Example 43 | R-1 | Production Example 85 | A-38 | A | Urethane resin | a-32 | 20 |
| Example 42 | T-42 | Production Example 43 | R-1 | Production Example 86 | A-39 | A | Urethane resin | a-33 | 20 |
| Example 43 | T-43 | Production Example 43 | R-1 | Production Example 93 | B-3 | B | Acrylic resin | a-34 | 20 |
| Example 44 | T-44 | Production Example 44 | R-2 | Production Example 87 | A-40 | A | Urethane resin | a-35 | 20 |
| Example 45 | T-45 | Production Example 45 | R-3 | Production Example 88 | A-41 | A | Urethane resin | a-36 | 20 |
| Example 46 | T-46 | Production Example 43 | R-1 | Production Example 89 | A-42 | A | Urethane resin | a-37 | 20 |
| Example 47 | T-47 | Production Example 43 | R-1 | Production Example 90 | A-43 | A | Urethane resin | a-42 | 20 |

TABLE 12

| Example | Flaky crystal particles: Average particle diameter/μm | Average thickness/μm | Average particle diameter/average thickness | Aggregate: Average height/μm | Average length/μm | Aspect ratio | Card house structure unevenness interval/μm | Surface roughness $R_Z$/μm | Dynamic friction coefficient |
|---|---|---|---|---|---|---|---|---|---|
| Example 1 | 1.3 | 0.5 | 2.7 | 20.0 | 42.2 | 2.1 | 0.9 | 21.1 | 0.42 |
| Example 2 | 1.2 | 0.49 | 2.4 | 22 | 40.2 | 1.8 | 0.9 | 23.1 | 0.41 |
| Example 3 | 1.3 | 0.48 | 2.8 | 21.0 | 86.3 | 4.1 | 0.8 | 22.1 | 0.41 |
| Example 4 | 1.3 | 0.49 | 2.8 | 20.2 | 204.5 | 10.1 | 0.9 | 21.3 | 0.40 |
| Example 5 | 1.0 | 0.5 | 2.0 | 20.0 | 20.3 | 1.0 | 0.8 | 21.1 | 0.32 |
| Example 6 | 1.0 | 0.5 | 2.0 | 20.0 | 20.3 | 1.0 | 1.0 | 23.1 | 0.33 |
| Example 7 | 1.0 | 0.5 | 2.0 | 20.0 | 40.2 | 2.0 | 0.7 | 20.1 | 0.36 |
| Example 8 | 1.2 | 0.49 | 2.4 | 10.3 | 22.7 | 2.2 | 0.9 | 11.4 | 0.40 |
| Example 9 | 1.3 | 0.48 | 2.8 | 21.0 | 86.2 | 4.1 | 0.9 | 22.1 | 0.41 |
| Example 10 | 1.3 | 0.48 | 2.8 | 21.0 | 86.2 | 4.1 | 1.0 | 22.1 | 0.40 |
| Example 11 | 1.3 | 0.48 | 2.8 | 21.0 | 86.3 | 4.1 | 0.9 | 22.1 | 0.40 |
| Example 12 | 1.3 | 0.48 | 2.8 | 21.0 | 86.4 | 4.1 | 1.1 | 23.2 | 0.39 |
| Example 13 | 1.3 | 0.48 | 2.8 | 21.0 | 86.2 | 4.1 | 1.1 | 24.3 | 0.38 |
| Example 14 | 1.1 | 0.49 | 2.2 | 4.1 | 4.9 | 1.2 | 0.9 | 5.2 | 0.30 |
| Example 15 | 1.3 | 0.48 | 2.6 | 29.9 | 34.2 | 1.1 | 0.8 | 32.1 | 0.31 |
| Example 16 | 1.2 | 0.5 | 2.4 | 14.6 | 30.8 | 2.1 | 0.8 | 15.7 | 0.41 |
| Example 17 | 1.2 | 0.5 | 2.4 | 15.1 | 63.5 | 4.2 | 0.9 | 16.2 | 0.40 |
| Example 18 | 1.2 | 0.49 | 2.4 | 22.3 | 44.6 | 2.0 | 1.0 | 23.4 | 0.40 |
| Example 19 | 1.3 | 0.49 | 2.8 | 20.1 | 82.4 | 4.1 | 1.1 | 21.2 | 0.41 |
| Example 20 | 1.3 | 0.49 | 2.5 | 4.2 | 127.5 | 29.8 | 0.8 | 5.3 | 0.31 |
| Example 21 | 1.1 | 0.40 | 2.2 | 11.2 | 12.5 | 1.1 | 0.9 | 12.3 | 0.33 |
| Example 22 | 1.4 | 0.48 | 2.9 | 10.3 | 105.3 | 10.2 | 1.0 | 11.4 | 0.35 |
| Example 23 | 1.4 | 0.5 | 2.8 | 3.9 | 4.3 | 1.1 | 1.1 | 5.0 | 0.32 |
| Example 24 | 1.3 | 0.5 | 2.6 | 4.2 | 63.8 | 15.2 | 0.9 | 5.3 | 0.33 |
| Example 25 | 0.1 | 0.005 | 18.8 | 10.2 | 22.3 | 2.2 | 0.1 | 11.3 | 0.25 |
| Example 26 | 1.1 | 0.9 | 1.2 | 10.0 | 23.4 | 2.3 | 0.7 | 11.1 | 0.28 |
| Example 27 | 1.3 | 0.51 | 2.6 | 10.0 | 20.3 | 2.0 | 1.1 | 11.1 | 0.35 |
| Example 28 | 2.0 | 0.51 | 3.8 | 10.3 | 19.6 | 1.9 | 1.7 | 11.4 | 0.35 |
| Example 29 | 1.0 | 0.05 | 20.4 | 10.2 | 19.5 | 1.9 | 0.7 | 11.3 | 0.31 |
| Example 30 | 0.1 | 0.005 | 18.8 | 10.2 | 21.3 | 2.1 | 0.1 | 11.3 | 0.25 |
| Example 31 | 1.5 | 0.12 | 12.2 | 10.3 | 20.7 | 2.0 | 1.2 | 11.4 | 0.32 |
| Example 32 | 2.2 | 1.2 | 1.8 | 10.4 | 22.9 | 2.2 | 2.1 | 11.5 | 0.25 |
| Example 33 | 2.2 | 1.1 | 2.0 | 10.2 | 23.6 | 2.3 | 2.0 | 11.3 | 0.27 |
| Example 34 | 0.1 | 0.005 | 18.8 | 10.3 | 20.7 | 2.0 | 0.1 | 11.4 | 0.25 |
| Example 35 | 2.3 | 0.98 | 2.4 | 10.1 | 21.3 | 2.1 | 2.0 | 11.2 | 0.31 |
| Example 36 | 1.4 | 0.48 | 2.9 | 1.0 | 1.1 | 1.1 | 1.1 | 2.1 | 0.30 |
| Example 37 | 1.2 | 0.49 | 2.4 | 4.1 | 3.4 | 0.8 | 0.9 | 5.2 | 0.30 |
| Example 38 | 1.2 | 0.52 | 2.3 | 29.7 | 24.2 | 0.8 | 0.9 | 31.5 | 0.31 |
| Example 39 | 1.4 | 0.51 | 2.7 | 40.2 | 48.2 | 1.2 | 1.0 | 41.3 | 0.28 |
| Example 40 | 1.3 | 0.5 | 2.7 | 3.8 | 190.4 | 50.1 | 1.1 | 4.9 | 0.30 |
| Example 41 | 0.03 | 0.005 | 6.0 | 10.2 | 21.6 | 2.1 | 0.03 | 11.3 | 0.22 |
| Example 42 | 0.1 | 0.003 | 31.4 | 10.3 | 20.6 | 2.0 | 0.1 | 11.4 | 0.21 |
| Example 43 | 1.2 | 1.1 | 1.1 | 10.1 | 20.4 | 2.0 | 0.9 | 11.2 | 0.27 |
| Example 44 | 5.7 | 2.1 | 2.7 | 10.1 | 22.3 | 2.2 | 5.4 | 11.2 | 0.24 |
| Example 45 | 4.5 | 1.2 | 3.8 | 10.1 | 23.3 | 2.3 | 4.5 | 11.2 | 0.28 |
| Example 46 | 10.9 | 2.1 | 5.2 | 10.2 | 21.4 | 2.1 | 10.9 | 11.3 | 0.18 |
| Example 47 | 1.3 | 0.5 | 2.6 | 19.0 | 41.2 | 2.2 | 2.1 | 19.8 | 0.34 |
| Comparative Example 1 | — | — | — | 48.5 | 48.5 | 1.0 | — | 49.6 | 0.10 |

TABLE 13

| Example | Environment at temperature of 15° C./humidity of 10% RH: At time of output of initial image | 1,000 sheets | 10,000 sheets | 20,000 sheets |
|---|---|---|---|---|
| Example 1 | 1 | 1 | 1 | 1 |
| Example 2 | 1 | 1 | 1 | 1 |
| Example 3 | 1 | 1 | 1 | 1 |
| Example 4 | 1 | 1 | 1 | 1 |
| Example 5 | 1 | 1 | 2 | 2 |
| Example 6 | 1 | 1 | 2 | 2 |
| Example 7 | 1 | 1 | 1 | 2 |
| Example 8 | 1 | 1 | 1 | 1 |
| Example 9 | 1 | 1 | 1 | 1 |
| Example 10 | 1 | 1 | 1 | 1 |
| Example 11 | 1 | 1 | 1 | 1 |
| Example 12 | 1 | 1 | 1 | 1 |

TABLE 13-continued

| Example | Environment at temperature of 15° C./humidity of 10% RH: At time of output of initial image | 1,000 sheets | 10,000 sheets | 20,000 sheets |
|---|---|---|---|---|
| Example 13 | 1 | 1 | 1 | 1 |
| Example 14 | 1 | 2 | 2 | 2 |
| Example 15 | 1 | 2 | 2 | 2 |
| Example 16 | 1 | 1 | 1 | 1 |
| Example 17 | 1 | 1 | 1 | 1 |
| Example 18 | 1 | 1 | 1 | 1 |
| Example 19 | 1 | 1 | 1 | 1 |
| Example 20 | 1 | 2 | 2 | 2 |
| Example 21 | 1 | 1 | 2 | 2 |
| Example 22 | 1 | 1 | 1 | 1 |
| Example 23 | 1 | 1 | 2 | 2 |
| Example 24 | 1 | 1 | 2 | 2 |

TABLE 13-continued

| Example | Environment at temperature of 15° C./humidity of 10% RH | | | |
|---|---|---|---|---|
| | At time of output of initial image | 1,000 sheets | 10,000 sheets | 20,000 sheets |
| Example 25 | 2 | 2 | 2 | 3 |
| Example 26 | 2 | 2 | 2 | 2 |
| Example 27 | 1 | 1 | 1 | 1 |
| Example 28 | 1 | 1 | 1 | 1 |
| Example 29 | 1 | 2 | 2 | 2 |
| Example 30 | 2 | 2 | 2 | 3 |
| Example 31 | 1 | 1 | 2 | 2 |
| Example 32 | 2 | 2 | 2 | 3 |
| Example 33 | 2 | 2 | 2 | 2 |
| Example 34 | 2 | 2 | 2 | 3 |
| Example 35 | 1 | 2 | 2 | 2 |
| Example 36 | 1 | 2 | 2 | 2 |
| Example 37 | 1 | 2 | 2 | 2 |
| Example 38 | 1 | 2 | 2 | 2 |
| Example 39 | 2 | 2 | 2 | 2 |
| Example 40 | 1 | 2 | 2 | 2 |
| Example 41 | 2 | 2 | 3 | 3 |
| Example 42 | 2 | 2 | 3 | 3 |
| Example 43 | 2 | 2 | 2 | 2 |
| Example 44 | 2 | 2 | 2 | 3 |
| Example 45 | 2 | 2 | 2 | 2 |
| Example 46 | 2 | 3 | 3 | 3 |
| Example 47 | 1 | 1 | 2 | 2 |
| Comparative Example 1 | 3 | 3 | 3 | 4 |

REFERENCE SIGNS LIST

1 electroconductive substrate
2 surface layer
3 conductive elastic layer
4 aggregate
5 reference line
6 height profile
7 charging member (electrophotographic member)
8 belt
9 weight
10 load meter
11 recorder While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-270183, filed on Dec. 11, 2012, which is hereby incorporated by reference herein in its entirety.

What is claimed is:

1. An electrophotographic member comprising:
an electroconductive substrate; and
a surface layer,
wherein:
the surface layer includes:
a binder resin; and
an aggregate of at least one crystal particle selected from the group consisting of a flaky crystal particle of magnesium carbonate and a flaky crystal particle of calcium carbonate;
an edge face of a card house structure formed of the crystal particle is exposed at a surface of the aggregate;
a surface of the surface layer includes a convex portion derived from the aggregate; and
a surface of the convex portion has unevenness reflecting a shape of the edge face of the card house structure exposed at the surface of the aggregate.

2. The electrophotographic member according to claim 1, wherein the crystal particle has an average thickness of 0.005 μm or more and 1 μm or less and an average particle diameter of 0.1 μm or more and 10 μm or less.

3. The electrophotographic member according to claim 1, wherein the unevenness reflecting the shape of the edge face of the card house structure exposed at the surface of the aggregate has an average unevenness interval of 0.1 μm or more and 10 μm or less.

4. A process cartridge comprising:
the electrophotographic member according to claim 1; and
an electrophotographic photosensitive member,
the process cartridge being removably mounted on a main body of an electrophotographic apparatus.

5. An electrophotographic apparatus comprising:
the electrophotographic member according to claim 1; and
an electrophotographic photosensitive member.

* * * * *